US006359529B1

(12) United States Patent
Tsunoda et al.

(10) Patent No.: US 6,359,529 B1
(45) Date of Patent: Mar. 19, 2002

(54) FILTERING DEVICE COMPRISING FILTERS, EACH HAVING A RESONANCE LINE, A COUPLING ELEMENT COUPLED TO SAID RESONANCE LINE, AND A SWITCH FOR SHORT-CIRCUITING SAID RESONANCE LINE

(75) Inventors: Kikuo Tsunoda; Hitoshi Tada, both of Ishikawa-ken (JP)

(73) Assignee: Murata Manufacturing co., Ltd. (JP)

( * ) Notice: Subject to any disclaimer, the term of this patent is extended or adjusted under 35 U.S.C. 154(b) by 0 days.

(21) Appl. No.: 08/998,252

(22) Filed: Dec. 24, 1997

(30) Foreign Application Priority Data

Dec. 27, 1996 (JP) ..... 8-349274

(51) Int. Cl.[7] ..... H01P 1/213; H01P 1/202; H01P 1/205

(52) U.S. Cl. ..... 333/101; 333/104; 333/127; 333/134; 333/202; 333/206; 333/204

(58) Field of Search ..... 333/101, 103, 333/104, 126, 129, 134, 206, 207, 205, 235, 204, 128, 127

(56) References Cited

U.S. PATENT DOCUMENTS

| | | | | |
|---|---|---|---|---|
| 4,467,296 A | | 8/1984 | Cohen et al. | 333/202 |
| 4,980,660 A | * | 12/1990 | Nakamura et al. | 333/101 |
| 5,023,935 A | * | 6/1991 | Vancraeynest | 333/132 X |
| 5,065,120 A | * | 11/1991 | Munn | 333/134 X |
| 5,521,561 A | * | 5/1996 | Yrjölä et al. | 333/104 X |
| 5,712,648 A | * | 1/1998 | Tsujiguchi | 333/134 X |
| 5,737,696 A | * | 4/1998 | Yorita | 333/134 X |
| 5,742,215 A | * | 4/1998 | Park | 333/204 |

FOREIGN PATENT DOCUMENTS

| | | |
|---|---|---|
| EP | 0520641 | 12/1992 |
| EP | 0570184 | 11/1993 |

OTHER PUBLICATIONS

European Search Report dated Apr. 13, 2000.
R.E. Fisher: "Broadbanding Microwave Diode Switches" IEEE Transactions on Microwave Theory and Techniques, vol. MTT–13, Sep. 1965, p. 706 XP000882479.

* cited by examiner

*Primary Examiner*—Robert Pascal
*Assistant Examiner*—Barbara Summons
(74) *Attorney, Agent, or Firm*—Ostrolenk, Faber, Gerb & Sofen, LLP

(57) ABSTRACT

The invention provides a filtering device of the transmission-reception switched type which can be constructed in a form with a reduced size at a low cost without having to use circuit elements such as a capacitor, a coil, and a transmission line forming a phase shift circuit which are not essential to the filtering device. Inner conductors serving as distributed-parameter resonance lines are formed in a dielectric block. There is provided a coupling line coupled with particular inner conductors. The open-circuited ends of these particular inner conductors are connected to an outer conductor via corresponding diode switches so that transmission and reception filters are switched from each other when either diode switch is selectively turned on.

9 Claims, 17 Drawing Sheets

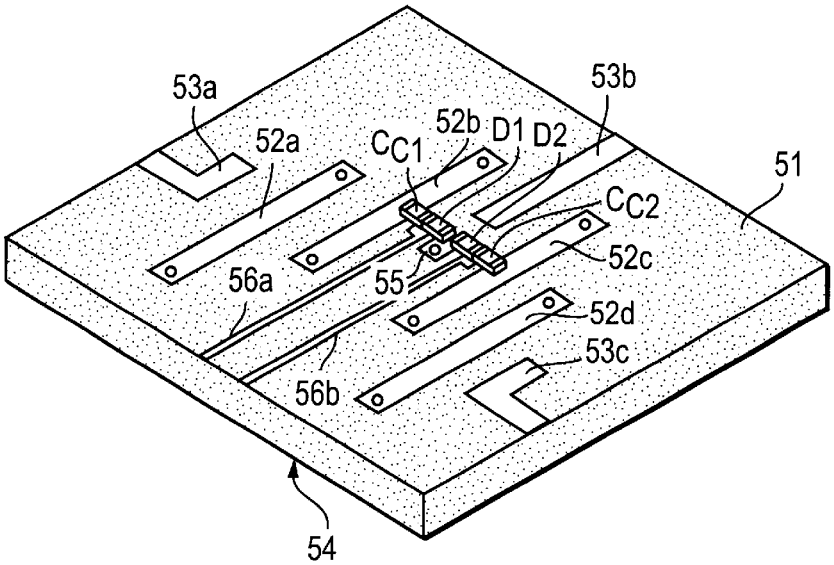
FIG. 29
FIG. 30
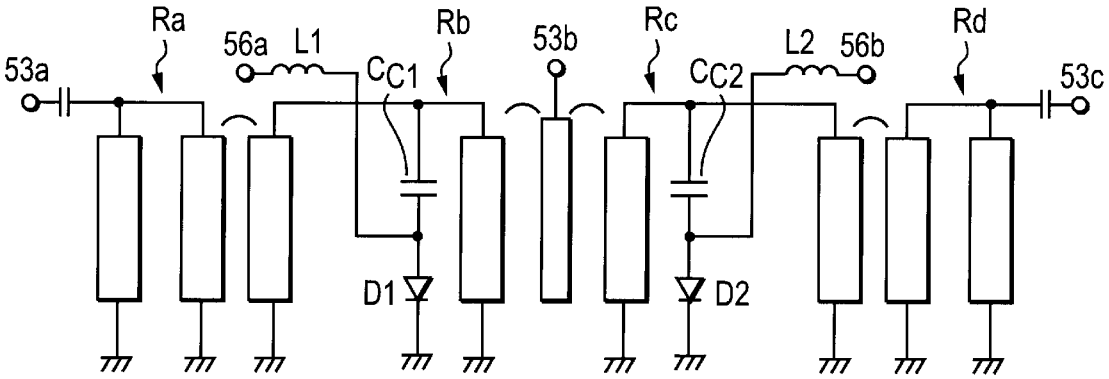
FIG. 31
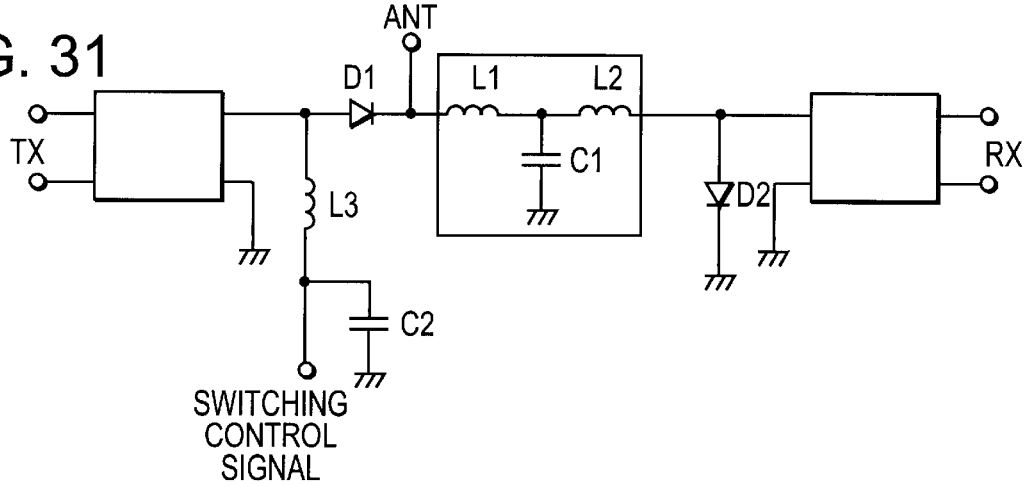

FILTERING DEVICE COMPRISING FILTERS, EACH HAVING A RESONANCE LINE, A COUPLING ELEMENT COUPLED TO SAID RESONANCE LINE, AND A SWITCH FOR SHORT-CIRCUITING SAID RESONANCE LINE

BACKGROUND OF THE INVENTION

1. Field of the Invention

The present invention relates to a filtering device used in a high-frequency device for use in a mobile communication system or the like.

2. Description of the Related Art

As a result of recent introduction of the TMDA technique into portable telephone systems, the communication scheme of intermittent transmission/reception in units of time slots has become widely used instead of the concurrent transmission/reception technique. As a result of the change in the communication scheme, the microwave filter which is located at the first stage of a radio communication device and which is used in common in transmission and reception has been changed from a combination of transmission and reception filters to a switching type filter in which a transmission filter and a reception filter are switched from time to time.

In general, when a transmission filter and a reception filter are switched from each other by a switch, isolation of the switching circuit makes it possible to reduce signal leakage from a transmission circuit to a reception circuit to a lower level than can be achieved by a single filter. Therefore, requirement of the attenuation characteristic for a filter of the transmission-reception switched type is less severe than that for a filter of the combined transmission-reception type. This makes it possible to realize a smaller-sized filter at a lower cost.

FIG. 31 illustrates a typical transmission-reception switched type filter. In FIG. 31, diodes D1 and D2 are used as switching devices for switching a transmission filter and a reception filter from each other. If a switching control current is applied so as to turn on both diodes D1 and D2 into a closed state, a transmission signal is passed through the transmission filter to an ANT terminal. However, because the transmission signal is shunted to ground by the diode D2, the transmission signal cannot reach the reception filter. On the other hand, when the switching control signal is given in such a manner as to turn off both diodes D1 and D2 into an open state, a reception signal is passed through the reception filter. In FIG. 31, L3 is a high-frequency choke coil and C2 is a high-frequency signal shunting capacitor. The combination of L3 and C2 prevents ingress of the RF signal to a control circuit which generates the switching control signal.

To improve the isolation of the switching circuit using diodes, it is more desirable to dispose the diodes in a shunted fashion. If the diodes are disposed in a series fashion, leakage of signal occurs due to residual capacitance when the diodes are in an off-state, which results in degradation in isolation between reception and transmission filters.

However, in the switching circuit of the type in which a switching device is turned on into a closed state so as to shunt the circuit, it is required that the impedance of the switching device seen from the antenna terminal should be as high as can be regarded as open-circuited thereby eliminating the influence of the closed switching device on the filter used. One known technique of achieving the above requirement is to add an LC phase shift circuit consisting of L1, L2, and C1 to the switching device as shown in FIG. 31. Another technique is to insert a λg/4 transmission line so that the impedance seen from the transmission filter becomes as high as can be regarded as substantially open-circuited.

Thus, it is an object of the present invention to provide a filtering device of the transmission-reception switched type which can be constructed in a form with a reduced size at a low cost without having to use circuit elements such as a capacitor and a coil forming a phase shift circuit which are not essential to the filtering device.

SUMMARY OF THE INVENTION

To achieve the above requirement of reducing the device size and the production cost without using a conventional phase shift circuit, the present invention provides a filtering device according to any aspect described below. According to a first aspect of the present invention, there is provided a filtering device comprising: a plurality of filters each having a distributed-parameter resonance line at least one end of which is open-circuited; and a coupling line, a coupling electrode, or a coupling element coupled to at least one distributed-parameter resonance line included in each filter, wherein a switch is connected to the above-described at least one distributed-parameter resonance line so that the open-circuited end of the above-described at least one distributed-parameter resonance line is short-circuited when the switch is operated.

FIG. 1 illustrates a specific example of the circuit configuration of the filtering device according to the above aspect of the invention. As shown in FIG. 1, the filtering device comprises: distributed-parameter resonance lines R11, R12, R13, R21, R22, and R23 whose one end is open-circuited; and coupling reactances k11, k12, k13, k14, k21, k22, k23, and k24 located between adjacent distributed-parameter resonance lines or between an input or output port and a first- or final-stage line. In this specific example, a filter 1 is formed between port 1 and port 3 and a filter 2 is formed between port 3 and port 2. Diode switches (hereinafter referred to simply as switches) D1 and D2 are connected between the open-circuited ends of the distributed-parameter resonance lines R13 and R21 and ground. Although a bias circuit for supplying a bias voltage to the switches D1 and D2 are needed, it is not shown in FIG. 1. The direction of the switches D1 and D2 is not limited to that shown in FIG. 1, but the direction may be determined in different manners depending on the configuration of the bias circuit used to supply a bias voltage to the switches D1 and D2.

In FIG. 1, when the switch D2 is in an open state and the switch D1 is in a closed state, the distributed-parameter resonance line R13 is short-circuited at its both ends, and thus it acts as a λ/2 resonator. In this state, the other distributed-parameter resonance lines act as λ/4 resonators and therefore they have a resonance frequency twice the signal frequency. As a result, the distributed-parameter resonance line R13 acts as a very high impedance (very low admittance) at frequencies in the signal frequency band. In this state, on the other hand, the coupling reactance k14 between the distributed-parameter resonance line R13 and the port 3 acts as an impedance directly connected to ground via the switch D1. Therefore, when seen from the port 3, the filter 1 is not short-circuited but it is seen as a circuit having a certain reactance. If the filter 2 is designed taking into account this reactance, the filter 2 can have desired characteristics independent of the filter 1. In the case where the filter 2 operates using the port 3 as an input port and the port 2 as an output port, when the switch D1 is in a closed state, a signal input to the port 3 is passed through the filter 2 and output to the port 2 but no signal is output to the port 1. On the other hand, in the case where the filter 2 operates using the port 2 as an input port and the port 3 as an output port, when the switch D1 is in a closed state, a signal input to the port 2 is passed through the filter 2 and output to the port 3, but no signal is input to the filter 1.

Conversely, if the switch D1 is in an open state and the switch D2 is in a closed state, the filter 1 can be used without being affected by the filter 2.

In the design of the filter, when the filter 2 is designed first so that the filter 2 has desired characteristics taking into account the effects of k14. This can be achieved by performing a simulation repeatedly on the filter 2 taking into account the reactance k14 while varying parameters of the respective elements in the filter 2 by small amounts at a time until desired characteristics are achieved. As a result, optimized parameters of the filter 2 are obtained, and thus the optimized value for the coupling reactance k21 between the port 3 and the distributed-parameter resonance line R21 is determined. This value for k21 is fixed, and the optimized parameters of the filter 1 located on the opposite side are determined by performing a simulation repeatedly while varying the parameters of the respective elements in the filter 2 by small amounts at a time.

In the above example, when the switch is turned on into a closed state, the λ/4 resonator one end of which is open-circuited and the other end of which is short-circuited is converted to a λ/2 resonator both ends of which arc short-circuited. Alternatively, the filtering device may also be constructed such that when a switch is turned on into a closed state, a λ/2 resonator whose both ends are open-circuited may be converted to a λ/4 resonator one end of which is open-circuited and the other end of which is short-circuited. In this case, when the switch is turned on, the resonance frequency becomes times the signal frequency, and thus the distributed-parameter resonance line acts as a very high impedance at frequencies in the signal frequency band.

In the above-described filtering device, when the switch is in an open state, the distributed-parameter resonance line connected to the switch operates in a normal mode. Alternatively, the distributed-parameter resonance line connected to the switch may operate in a normal mode when the switch is in a closed state. That is, according to a second aspect of the present invention, there is provided a filtering device comprising: a plurality of filters each having a distributed-parameter resonance line at least one end of which is short-circuited; and a coupling line, a coupling electrode, or a coupling element coupled to at least one distributed-parameter resonance line included in each filter, wherein a switch is connected to the above-described at least one distributed-parameter resonance line so that the short-circuited end of the above-described at least one distributed-parameter resonance line is open-circuited when the switch is operated. In this configuration, in the case where the other end of the distributed-parameter resonance line is short-circuited, when the switch is turned off into an open state, the λ/2 resonator both ends of which are short-circuited is changed to a λ/4 resonator one end of which is short-circuited and the resonance frequency becomes 1/2 times the original resonance frequency. On the other hand, in the case where the other end of the distributed-parameter resonance line is open-circuited, when the switch is turned off into an open state, the λ/4 resonator one end of which is short-circuited is changed to a λ/2 resonator both ends of which are open-circuited, and the resonance frequency becomes 2 times the original resonance frequency. In either case, when the switch is turned off into the open state, the distributed-parameter resonance line comes to behave as a very high impedance, and therefore the filter connected to the opened switch can be substantially isolated from the other filter.

A filtering device may also be constructed, according to a third aspect of the invention corresponding to claim 3, using a plurality of filters each including a distributed-parameter resonance line both ends of which are short-circuited, in such a manner that a switch is connected to a substantially central part of the distributed-parameter resonance line so that the substantially central part is selectively short-circuited when the switch is operated. In this configuration, when the switch is in an open state, the distributed-parameter resonance line acts as a λ/2 resonator both ends of which are short-circuited. When the switch is turned on into a closed state, the center of the distributed-parameter resonance line is short-circuited, and, as a result, the effective length of the resonance line becomes half the original length. As a result, the resonance frequency becomes twice the original resonance frequency, and the distributed-parameter resonance line behaves as a very high impedance at frequencies in the signal frequency band.

According to a fourth aspect of the invention, there is provided a filtering device including a plurality of filters each composed of a distributed-parameter resonance line, wherein a switch is connected to one of the distributed-parameter resonance lines located at the first stage counted from a coupling line, coupling electrode, or coupling element, so that when the switch is operated a predetermined filter becomes negligible or comes to behave as merely a reactance seen from the coupling line or coupling electrode coupled to the distributed-parameter resonance lines of each filter.

The structure of the filtering device is not limited to an integral structure such as that described above, but it may also be constructed in such a manner that a plurality of filters constructed in a separate fashion are connected to a common port via a transmission line such as a microstrip line. In this case, a switch may be connected to a distributed-parameter resonance line at the first stage counted from that common port. The number of coupling lines or coupling electrodes sharing the input/output terminal it not limited to one. For example, in the case where an antenna terminal ANT1 is used in common in both transmission and reception, and an RX terminal is used in common to output a reception signal which is received by either of two antenna terminals ANT1 and ANT2 and is transferred to the RX terminal after being passed through either of two RX filters, switches D1 and D2 may be connected to distributed-parameter resonance lines R13 and R21, respectively, at the first stage counted from the terminal ANT1, and switches D3 and D4 may be connected to distributed-parameter resonance lines R22 and R32, respectively, at the first stage counted from the terminal RX. In this configuration, when a signal is transmitted, the switch D2 is turned on so that the signal to be transmitted is prevented from reaching RX or ANT2. When a signal is received, the switch D3 is turned on so that the signal received by ANT2 is transferred to the terminal RX via the RX filter 2 or otherwise the switch D4 is turned on so that the signal received by ANT1 is transferred to the terminal RX via the RX filter 1. By properly controlling the above switching operation, antenna diversity can be achieved.

Furthermore, the above technique of the invention may also be applied to a filtering device in which one port is used in common as an input/output port by thee or more filters as shown in FIG. 4. In this case, switches D1, D2, and D3 are connected to distributed-parameter resonance lines R11, R21, and R31, respectively, at the first stage counted from port 4.

In the case where a filter at a certain location relative to a coupling line or coupling electrode is isolated so that it does not act as a filter as is the case in the above-described examples, a switch is connected to a distributed-parameter resonance line located at the first stage counted from the coupling line or coupling electrode. Alternatively, according to a fifth aspect of the invention, a switch may be connected to an open-circuited end of one of the distributed-parameter resonance lines located at the second stage counted from the coupling line or coupling electrode so that the filter characteristics can be switched by controlling the switch. In the example shown in FIG. 5, when switch D1 is in an open state, a filter 1 acts as a bandpass filter consisting of three stages of resonators realized by distributed-parameter resonance lines R11, R12, and R13. If the switch D1 is turned off; the open-circuited end of the distributed-parameter resonance line R1 is grounded via a reactance k12, and thus the distributed-parameter resonance line R11 and a coupling reactance kill comes to act as an one-stage trap circuit (bandstop filter). As a result, in this state, the filtering device acts as a bandpass filter consisting of a filter 2 formed between the port 1 and the port 2 and the one-stage trap circuit.

According to a sixth aspect of the invention, there is provided a filtering device in which at least one distributed-parameter resonance line of those forming a plurality of filters is shared by the plurality of filters, and a coupling line, coupling electrode, or a coupling element is coupled with that distributed-parameter resonance line shared. For example, as shown in FIG. 6, a distributed-parameter resonance line R3 is used in common, and one filter is formed by three stages of resonators realized by distributed-parameter resonance lines R11, R12, and R3 while another filter is formed by three stages of resonators realized by distributed-parameter resonance lines R21, R22, and R3. In this case, switches D1 and D2 are connected to the distributed-parameter resonance lines R12 and R22, respectively, at the second stage counted from the port 3. When the switch D1 is in a closed state, a reactance k31 is connected between the open-circuited end of the distributed-parameter resonance line R3 and ground. In this state, parameters are determined so that the filter formed by R21, R22, and R3 has desired characteristics. On the other hand, when the switch D2 is in a closed state, a reactance k23 is connected between the open-circuited end of the distributed-parameter resonance line R3 and ground. In this state, parameters are determined so that the filter formed by R11, R12, and R3 has desired characteristics.

Referring now to FIGS. 7(A), 7(B), 8(A) and 8(B), examples of circuits for supplying a bias voltage to diode switches will be described below.

In the example of a bias voltage supply circuit shown in FIG. 7(A), a DC blocking capacitor Cc is connected in series to a diode switch D and both ends of the diode switch D are connected to respective RF choke circuits each consisting of an inductor L and a capacitor CB. If a bias voltage is applied between terminals $T_B$ and $T_B$ so that the diode D is biased in a forward direction, then the diode D is turned on into a closed state and thus the path between terminals T1 and T2 becomes conductive for a high-frequency signal. In the example shown in FIG. 7(B), a DC blocking capacitor Cc is connected to one end of a diode switch D and the other end of the diode switch is grounded. Furthermore, an RF choke circuit consisting of an inductor L and a capacitor $C_B$ is also connected to the one end of the diode D. If a bias voltage is applied to the diode D via a terminal $T_B$, a terminal T is grounded (short-circuited) for a high-frequency signal.

In the example shown in FIG. 8(A), a bias voltage is applied selectively to either one of terminals $T_{B1}$, and $T_{B2}$ so as to turn on either one of switches D1 and D2. In the example shown in FIG. 8(B), if a positive bias voltage is applied to a common terminal $T_B$, then a switch D1 is turned on. Conversely, if a negative bias voltage is applied to the common terminal $T_B$, then a switch D2 is turned on.

The filtering device according to any of aspects of the described above may be realized, in accordance with a seventh aspect of the invention, by using a plurality of inner conductors each acting as a distributed-parameter resonance line formed in one or more dielectric blocks.

The filtering device according to any of aspects of the invention may also be realized, in accordance with an eighth aspect of the invention corresponding to Claim 8, by using a plurality of dielectric coaxial resonators each acting as a distributed-parameter resonance line.

According to a ninth aspect of the invention, an inner conductor is formed on the inner surface of a hole in a dielectric block or in a dielectric coaxial resonator, and the switch described above is disposed inside the hole or on an opening end of the hole thereby disposing the switch in an integral fashion on the filtering device.

According to a tenth aspect of the invention, an element for supplying a bias voltage to the switch is disposed together with the switch inside the hole or on the opening end of the hole. This allows the bias voltage supply circuit to be also integrated on the filtering device.

According to a eleventh aspect of the invention, microstrip lines formed on a dielectric plate are employed as the distributed-parameter resonance lines, and a switch is disposed on the dielectric plate. This makes it possible to realize a filtering device on which the switch is integrated.

According to a twelfth aspect of the invention, an element for supplying a bias voltage to the switch is disposed on the dielectric plate. This makes it possible to realize a filtering device on which the bias voltage supply circuit is also integrated.

BRIEF DESCRIPTION OF THE DRAWINGS

FIG. 29 is a perspective view of a thirteen embodiment of a filtering device according to the invention;

FIG. 30 is an equivalent circuit diagram of the filtering device according to the thirteenth embodiment of the invention; and FIG. 31 is a diagram illustrating an example of a filter switching circuit according to a conventional technique.

DESCRIPTION OF THE PREFERRED EMBODIMENTS

A first embodiment of a filtering device according to the present invention will be described below with reference to FIGS. 9 to 11.

Figure 1:
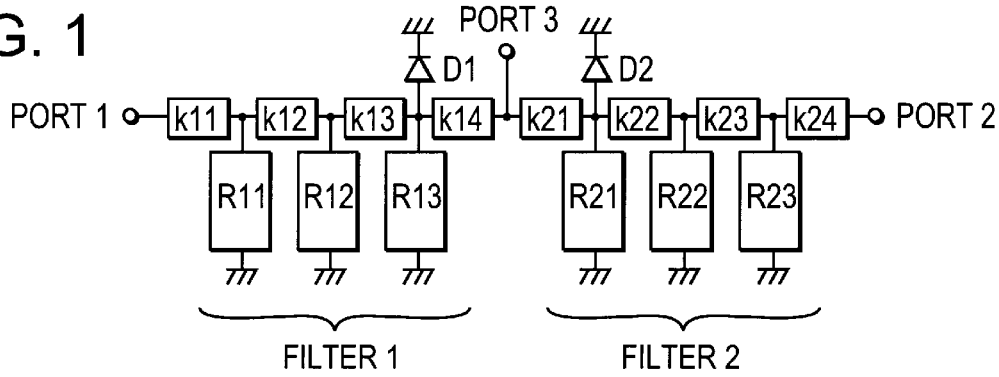
FIG. 1 is a diagram illustrating an example of the configuration of a filtering device according to a first or fourth aspect of the invention.
Figure 2:
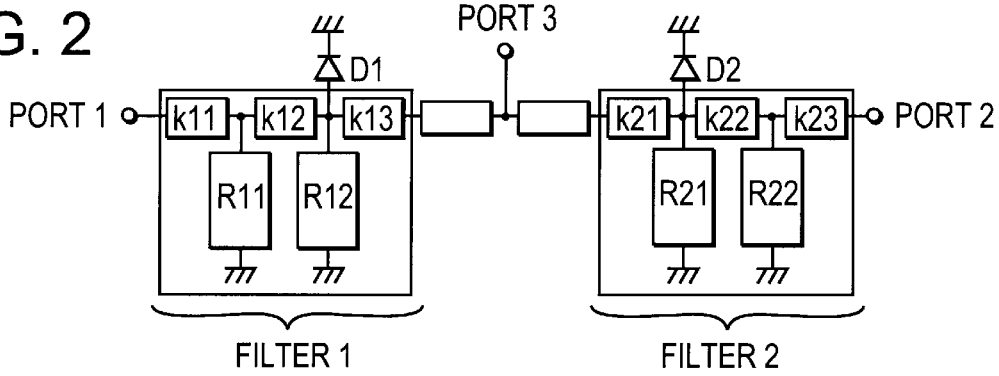
FIG. 2 is a diagram illustrating another example of the configuration of a filtering device according to a first or fourth aspect of the invention.
Figure 9:
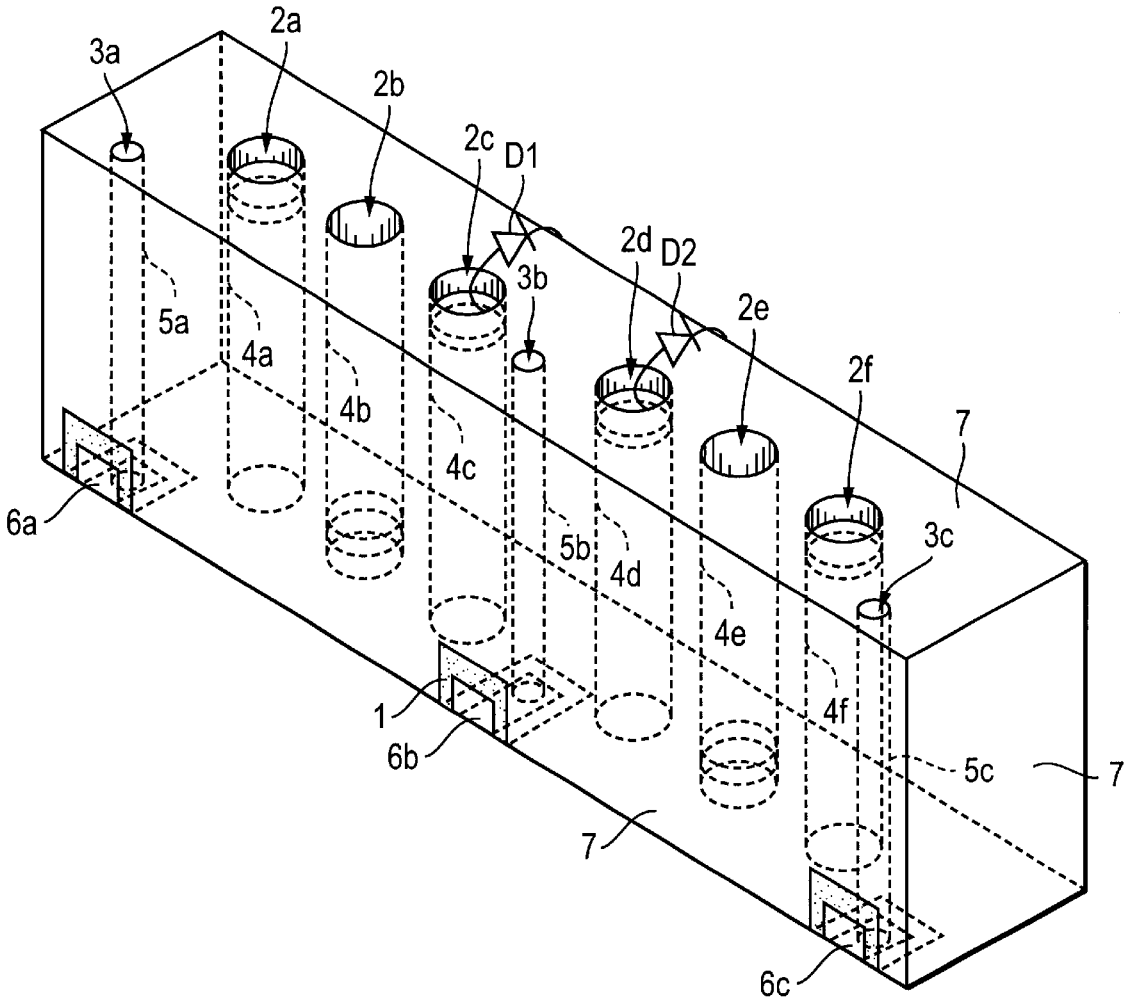
FIG. 9 is a perspective view of a first embodiment of a filtering device according to the invention.

FIG. 9 is a perspective view of the filtering device. As shown in FIG. 9, inner conductor holes 2*a*, 2*b*, 2*c*, 2*d*, 2*e*, and 2*f* and coupling line holes 3*a*, 3*b*, and 3*c* are formed in a hexahedron-shaped dielectric block 1. The inner surfaces of the inner conductor holes 2*a*, 2*b*, 2*c*, 2*d*, 2*e*, and 2*f* are covered with inner conductors 4*a*, 4*b*, 4*c*, 4*d*, 4*e*, and 4*f*, respectively, and coupling lines 5*a*, 5*b*, and 5*c* are formed in the coupling line holes 3*a*, 3*b*, and 3*c*, respectively. Input/output terminals 6*a*, 6*b*, and 6*c* extending from the coupling lines 5*a*, 5*b*, and 5*c* are formed on the outer surface of the dielectric block 1. Nearly all areas of the outer surface, except for those areas where the input/output terminals are formed, are covered with an outer conductor 7. A non-conducting portion is formed in each inner conductor 4*a*–4*f* at a location near one end thereof so that one open end of each inner conductor hole acts as an short-circuited end and the non-conducting portion near the opposite open end acts as an open-circuited end of the corresponding distributed-parameter resonance line and thus each distributed-parameter resonance line acts as a $\lambda/4$ resonator. These distributed-parameter resonance lines are disposed in an interdigital fashion. The open-circuited ends of the inner conductors 4*c* and 4*d* are connected to the outer conductor 7 via switches D1 and D2, respectively. The direction of the switches D1 and D2 is not limited to that shown in FIG. 1, but the direction may be determined in different manners depending on the configuration of the bias circuit used to a bias voltage to the switches D1 and D2. The coupling line 5*a* has distributed coupling with the inner conductor 4*a*. Similarly, the coupling line 5*c* has distributed coupling with the inner conductor 4*f*. The coupling line 5*b* has distributed coupling with the inner conductors 4*c* and 4*d*. In this configuration, the part between the input/output terminals 6*a* and 6*b* serves as a bandpass filter consisting of three stages of resonators realized by the inner conductors 4*a*, 4*b*, and 4*c*, respectively. The part between the input/output terminals 6*b* and 6*c* serves as a bandpass filter consisting of three stages of resonators realized by the inner conductors 4*d*, 4*e*, and 4*f*, respectively.

Namely, a duplexer is provided as a whole. If the part between the input/output terminals 6*a* and 6*b* is served as a transmission filter and the part between the input/output terminals 6*b* and 6*c* is served as a reception filter, the duplexer can be used as a antenna duplexer in which the input/output terminal 6*b* is connected to an antenna, the input/output terminal 6*a* is connected to an output of a transmission circuit and the input/output terminal 6*c* is connected to an input of a reception circuit.

Figure 10A:
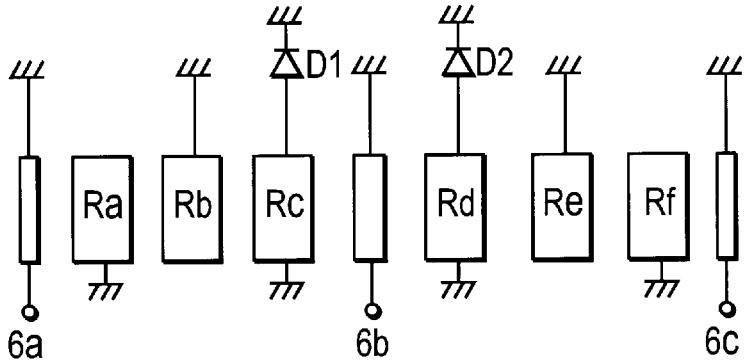
FIGS. 10(A), 10(B) and 10(C) are an equivalent circuit diagrams of the filtering device shown in FIG. 9.
Figure 10B:
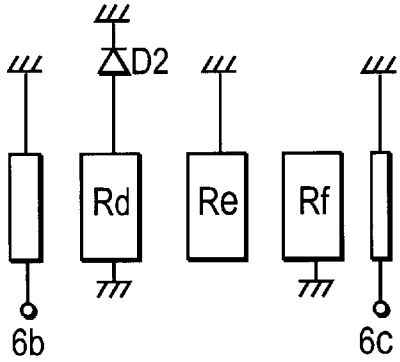
Figure 10C:
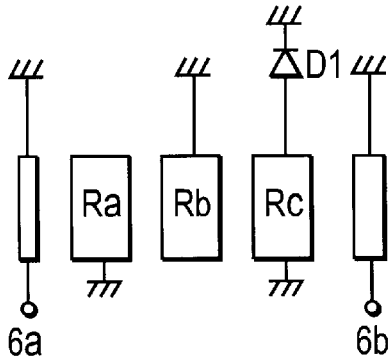

FIGS. 10(A), 10(B) and 10(C) illustrate an equivalent circuit of the filtering device shown in FIG. 9. The equivalent circuit for the case where both switches D1 and D2 are in an open state is shown in FIG. 10(A). In these figures, Ra, Rb, Rc, Rd, Re, and Rf correspond to the inner conductors 4*a*, 4*b*, 4*c*, 4*d*, 4*e*, and 4*f* acting as resonators shown in FIG. 1. If the switch D1 is turned on, the resonators Ra, Rb, and Rc are isolated from the circuit, and thus the circuit becomes equivalent to that shown in FIG. 10(B). That is, in FIG. 9, if the switch D1 is turned on, the inner conductor 4*c* comes to act as merely a ground conductor (shielding conductor) connected between the upper and lower portions of the outer conductor formed on the outer surface of the dielectric block 1. In this state, there is substantially no coupling between the inner conductor 4*c* and the coupling line 5*b*. Conversely, if the switch D2 is turned on, the resonators Rd, Re, and Rf are isolated from the circuit as shown in FIG. 10(C).

Figure 11A:
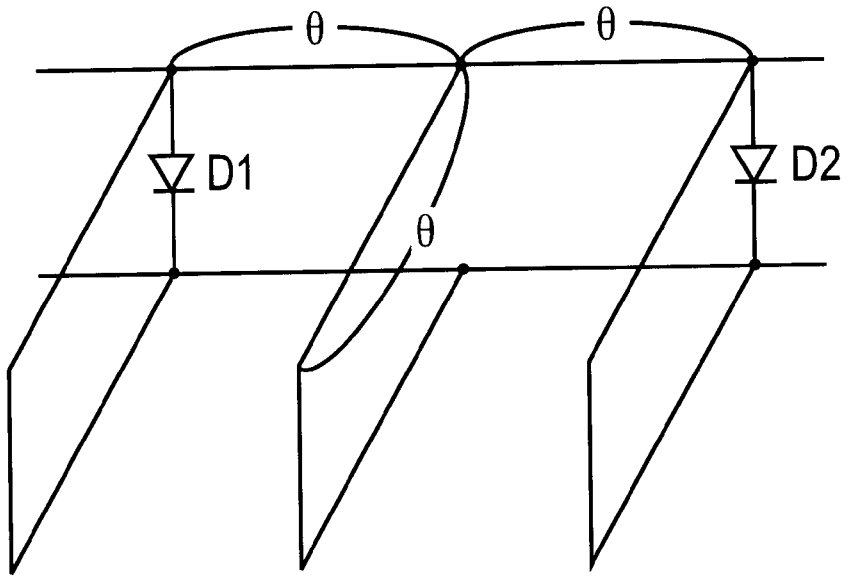
FIGS. 11(A) and 11(B) are representations, in the form of an equivalent circuit, of distributed coupling associated with a coupling line.
Figure 11B:
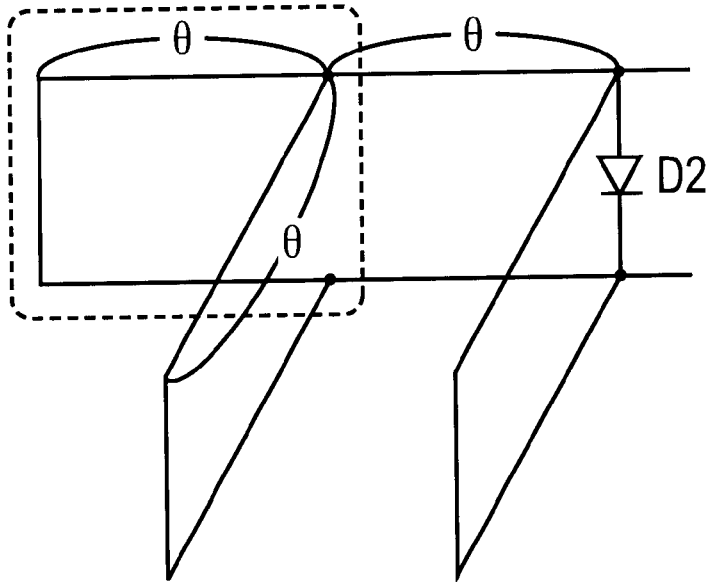

FIG. 11(A) is a representation, in the form of an equivalent circuit, of the distributed coupling between the coupling line 5*c* and the inner conductors 4*c* and 4*d* shown in FIG. 9. If the switch D1 is turned on, the distributed coupling will be represented by the equivalent circuit shown in FIG. 11(B). However, the part surrounded by a broken line in FIG. 11(B) is merely an equivalent representation, and such an element is not present in the actual circuit. In reality, the inner conductor 4*c* shown in FIG. 9 acts as a ground conductor, and the characteristic impedance seen from the coupling line 5*b* to the ground conductor is equivalently represented by the part surrounded by the broken line in FIG. 11(B).

Figure 12:
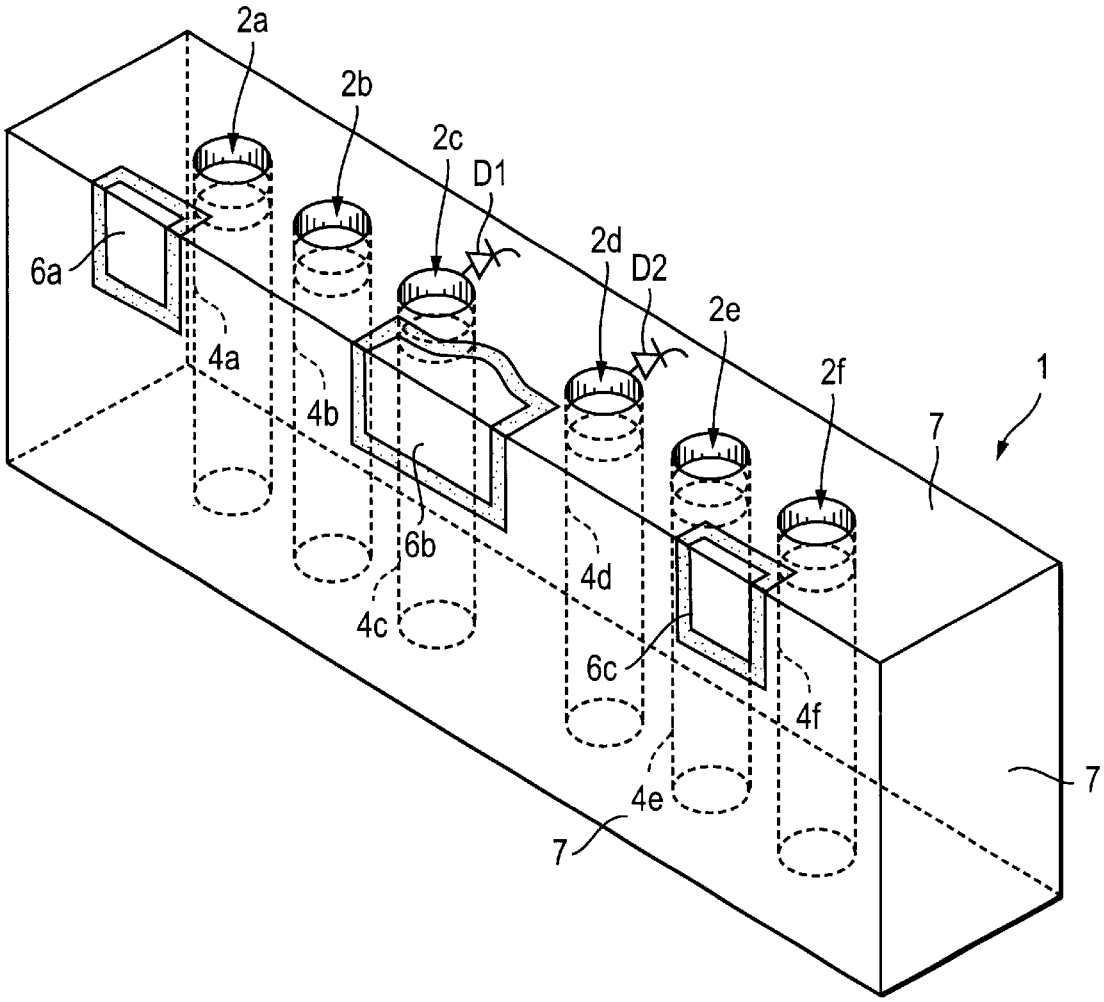
FIG. 12 is a perspective view of a second embodiment of a filtering device according to the invention.
Figure 13:
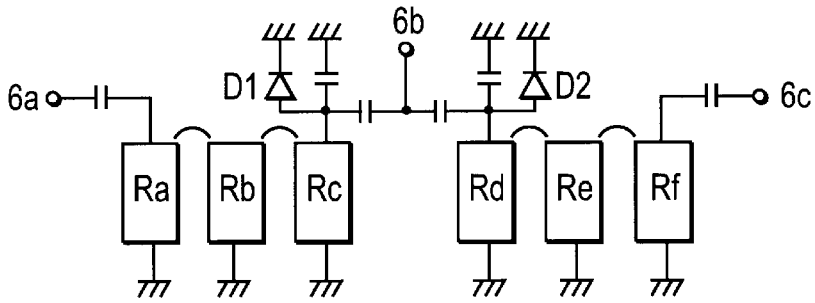
FIG. 13 is an equivalent circuit diagram of the filtering device shown in FIG. 12.

FIGS. 12 and 13 illustrate the structure of a filtering device according to a second embodiment of the invention. In this filtering device, inner conductor holes 2*a,* 2*b,* 2*c,* 2*d,* 2*e,* and 2*f* are formed in a dielectric block 1, and the inner surfaces thereof are covered with inner conductors 4*a,* 4*b,* 4*c,* 4*d,* 4*e,* and 4*f,* respectively. Input/output terminals 6*a,* 6*b,* and 6*c* are formed on the outer surface of the dielectric block 1. Nearly all areas of the outer surface, except for those areas where the input/output terminals are formed, are covered with an outer conductor 7. A non-conducting portion is formed in each inner conductor 4*a*–4*f* at a location near one end thereof so that one open end of each inner conductor hole acts as an short-circuited end and the non-conducting portion near the opposite open end acts as an open-circuited end of the corresponding distributed-parameter resonance line and thus each distributed-parameter resonance line acts as a λ/4 resonator. These distributed-parameter resonance lines are disposed in a comb-line form in which the non-conducting portion in each inner conductor is located on the same side. In this structure, the input/output terminals 6*a* and 6*c* are capacitively coupled with the inner conductors 4*a* and 4*f,* respectively, at locations near their open-circuited ends, and the input/output terminal 6*b* is capacitively coupled with the inner conductors 4*c* and 4*d* at locations near their open-circuited ends. The open-circuited ends of the inner conductors 4*c* and 4*d* are connected to the outer conductor 7 via switches D1 and D2, respectively.

FIG. 13 illustrates an equivalent circuit of the filtering device shown in FIG. 12. In FIG. 13, Ra to Rf correspond to the inner conductors 4*a* to 4*f* acting as resonators shown in FIG. 12. Adjacent resonators are coupled with each other in a comb-line fashion, and input/output terminals are capacitively coupled with resonators adjacent to them. When the switch D1 is in a closed state, the part between the input/output terminals 6*b* and 6*c* serves as a bandpass filter consisting of three stages of resonators. Conversely, when the switch D2 is in a closed state, the part between the input/output terminals 6*a* and 6*b* serves as a bandpass filter consisting of three stages of resonators.

Figure 14:
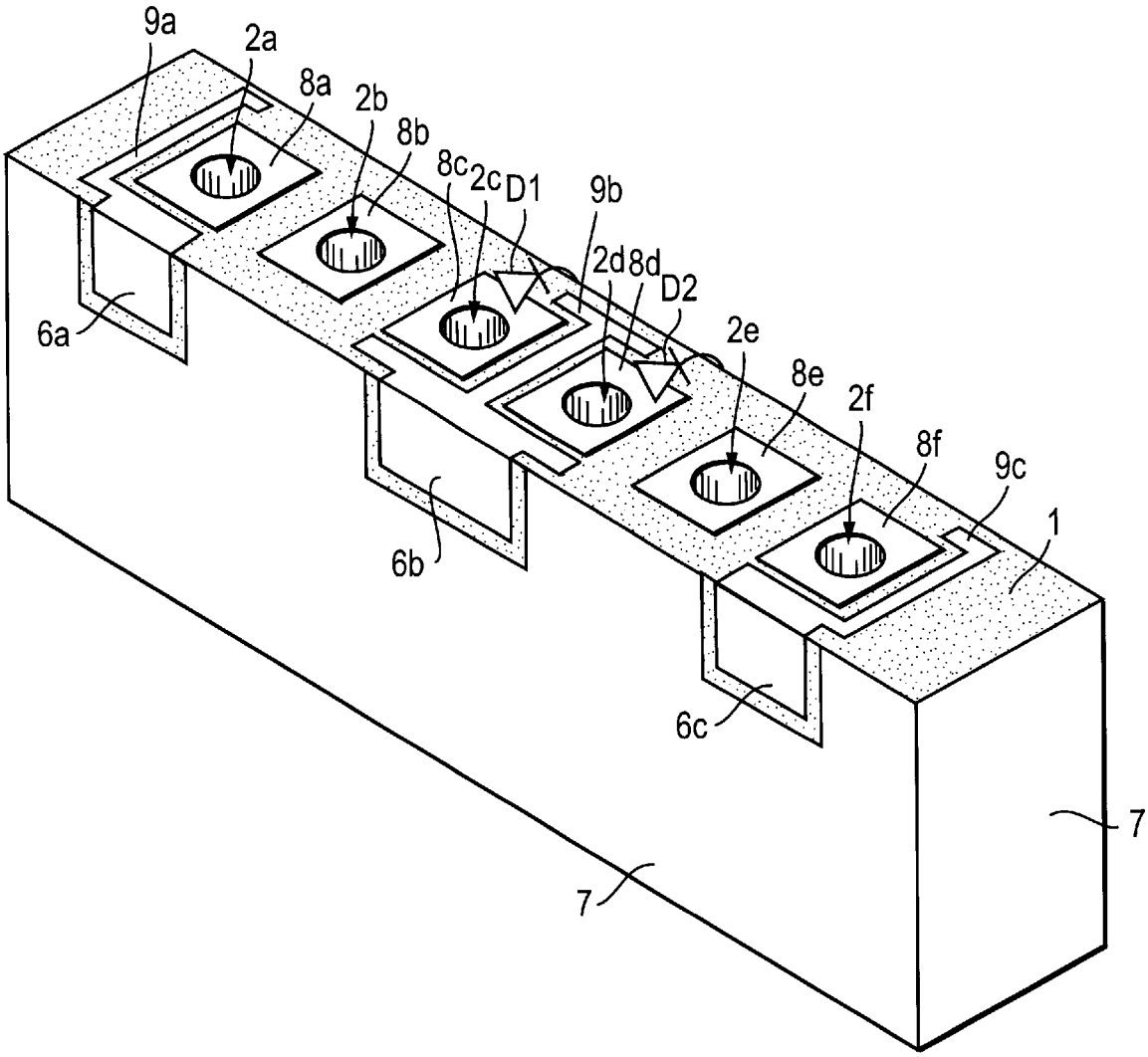
FIG. 14 is a perspective view of a third embodiment of a filtering device according to the invention.

FIG. 14 is a perspective view illustrating a third embodiment of a filtering device according to the invention. In this embodiment, inner conductor holes 2*a* to 2*f* are formed in a dielectric block 1 and the inner surfaces of the these inner conductor holes are covered with an inner conductor. Open-circuited end electrodes 8*a* to 8*f* extending from the corresponding inner conductors are formed on the upper surface of the dielectric block 1 as shown in FIG. 14. Furthermore, coupling electrodes 9*a,* 9*b,* and 9*c* are formed on the upper surface of the dielectric block 1, and input/output terminals 6*a,* 6*b,* and 6*c* extending from the corresponding coupling electrodes are formed as shown in the figure. The side walls and the bottom surface of the dielectric block 1 are covered with an outer conductor 7. The open-circuited end electrodes 8*c* and 8*d* are connected to the outer conductor via switches D1 and D2, respectively. In this embodiment, the resonators realized by the respective inner conductors are coupled with one another via capacitances between adjacent open-circuited end electrodes. Similarly, the input/output terminals are coupled with the resonators adjacent to the input/output terminals via capacitances between the corresponding open-circuited end electrodes and coupling electrodes. If the switch D1 is turned on, the inner conductor hole 2*c* acts as merely a ground electrode to the coupling electrode 9*b* and the input/output terminal 6*b,* and three stages of resonators between the input/output terminals 6*b* and 6*c* act as a bandpass filter. Conversely, when the switch D2 is turned on, the inner conductor hole 2*d* acts as merely a ground electrode to the coupling electrode 9*b* and the input/output terminal 6*b,* and three stages of resonators between the input/output terminals 6*a* and 6*b* act as a bandpass filter.

Although in the example shown in FIG. 14, coupling capacitors are formed on the dielectric block, coupling elements such as chip capacitors may be attached directly to the dielectric block.

Figure 15:
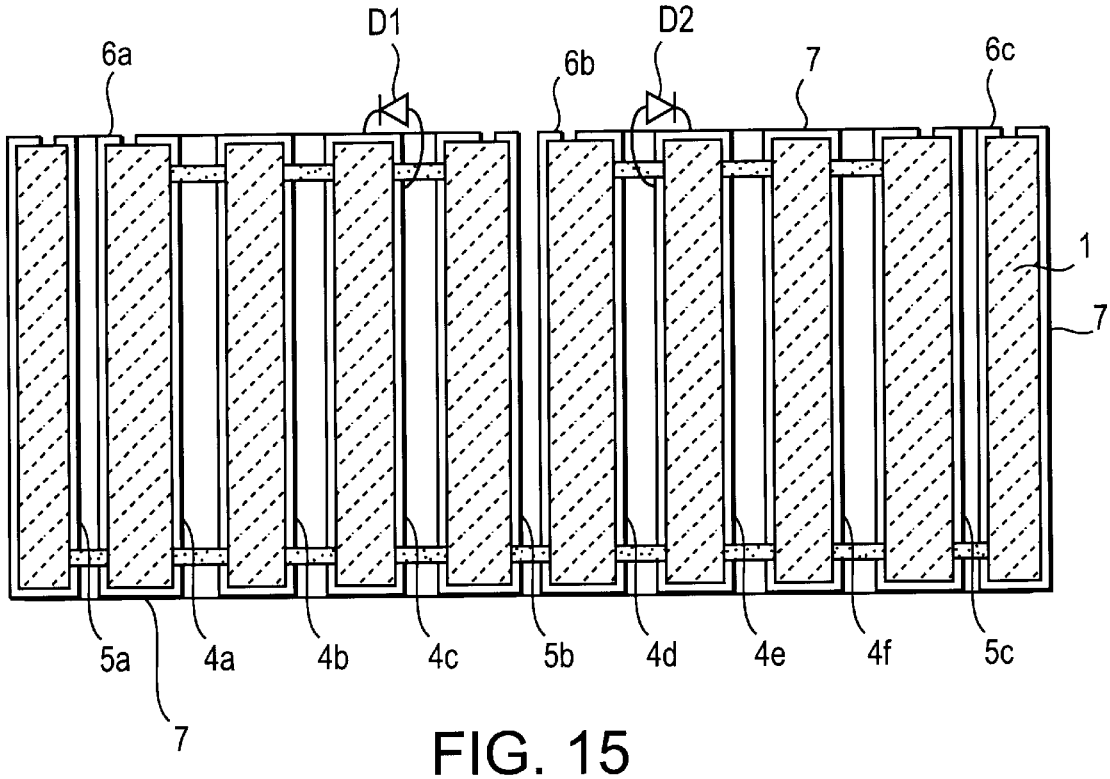
FIG. 15 is a perspective view of a fourth embodiment of a filtering device according to the invention.

FIG. 15 is a cross-sectional view illustrating a fourth embodiment of a filtering device according to the invention. In contrast to the first to third embodiments in which each distributed-parameter resonance line acts as a λ/4 resonator, each distributed-parameter resonance line in this fourth embodiment acts as a λ/2 resonator both ends of which are open-circuited. In this embodiment, as shown in FIG. 15, inner conductor holes and coupling line holes are formed in a dielectric block 1, and the inner surfaces of the inner conductor holes are covered with inner conductors 4*a* to 4*f* while coupling lines 5*a,* 5*b,* and 5*c* are formed in the coupling line holes. Non-conducting portions are formed in each inner conductor 4*a*–4*f* at locations near both ends so that open-circuited ends are formed at the non-conducting portions. Each coupling line 5*a,* 5*b,* and 5*c* has a similar non-conducting portion formed near its one end. One end of each inner conductor 4*c* and 4*d* is connected to the outer conductor 7 via a switch D1 or D2.

Figure 16:
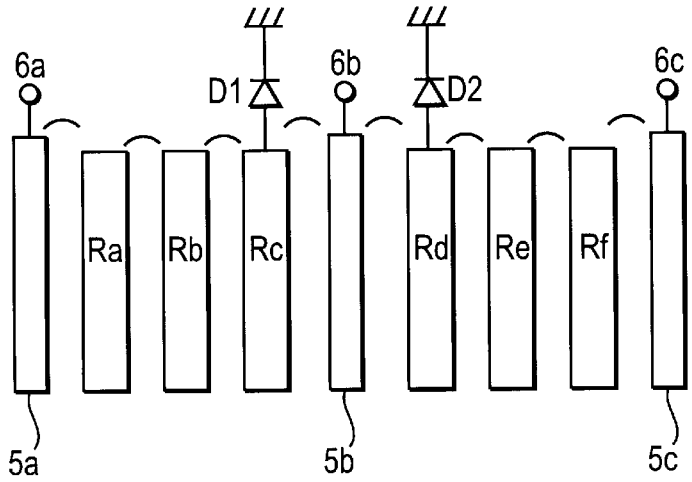
FIG. 16 is an equivalent circuit diagram of the filtering device according to the fourth embodiment of the invention.

FIG. 16 illustrates an equivalent circuit of the filtering device shown in FIG. 15. In FIG. 16, Ra to Rf correspond to the resonators realized by the inner conductors 4*a* to 4*f* shown in FIG. 15. When the switch D1 is in a closed state, the resonator Rc acts as a λ/4 resonator one end of which is open-circuited and the other end of which is short-circuited, and has a resonance frequency 1/2 times the resonance frequency of the other resonators. When seen from the coupling line 5*b,* therefore, the resonator Rc behaves as a very high impedance at frequencies in the signal frequency band. As a result, the resonators Ra to Rc do not operate as a filter. Conversely, when the switch D2 is in a closed state, the resonator Rd behaves as a very high impedance or a very low admittance at frequencies in the signal frequency band when seen from the coupling line 5*b*. As a result, the resonators Rd to Rf do not operate as a filter.

Figure 17:
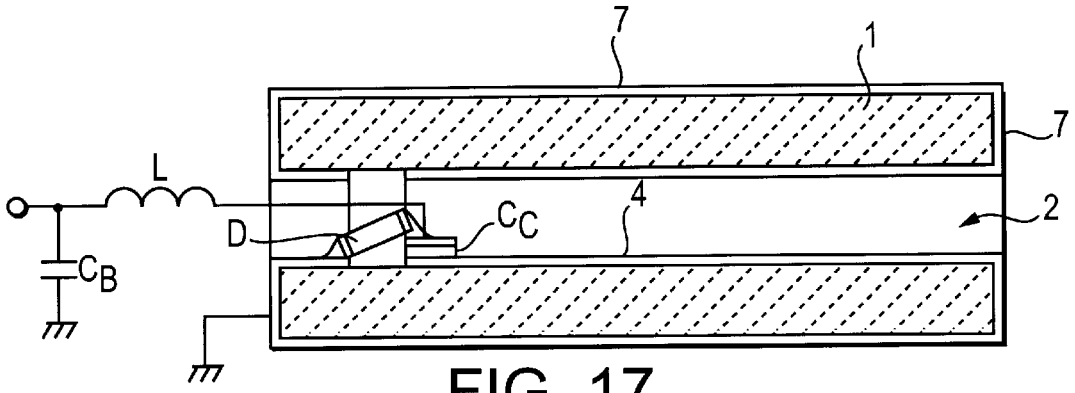
FIG. 17 is a cross-sectional view of a fifth embodiment of a filtering device according to the invention.

In the following fifth, sixth, and seventh embodiments, techniques of mounting diode switches will be described with reference to FIGS. 17 to 19. In the example shown in FIG. 17, a DC blocking capacitor Cc is attached to the inner conductor 4 at a location near its open-circuited end so that one end of the DC blocking capacitor Cc is connected to the inner conductor 4, and a diode switch D is disposed across the non-conducting portion in the inner conductor 4 so that the diode switch D is located between the open end of the inner conductor hole 2 and the other end of the DC blocking capacitor Cc. A bias voltage is applied to the node at which the diode switch D and the DC blocking capacitor Cc are connected to each other, via an RF choke circuit consisting of L and $C_B$ disposed between that node and the outer conductor 7 (ground).

Figure 18:
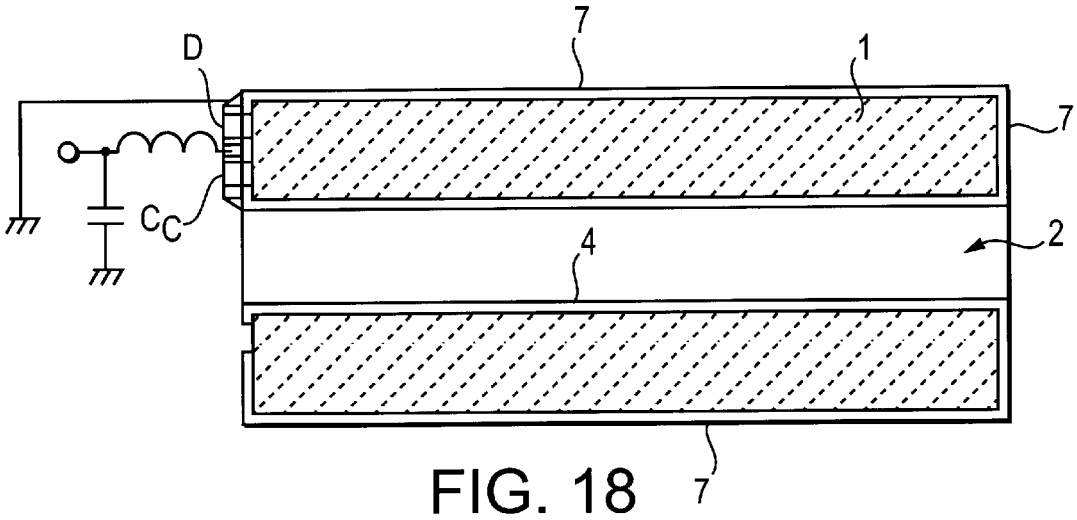
FIG. 18 is a cross-sectional view of a sixth embodiment of a filtering device according to the invention.

In the example shown in FIG. 18, an open-circuited end of the inner conductor 4 is formed on one open end of the inner conductor hole 2. A DC blocking capacitor Cc and a diode switch D are connected in series between the open-circuited end of the inner conductor 4 and the outer conductor 7. Furthermore, as in the example shown in FIG. 17, a bias voltage is applied across the diode switch D via an RF choke circuit.

Figure 19:
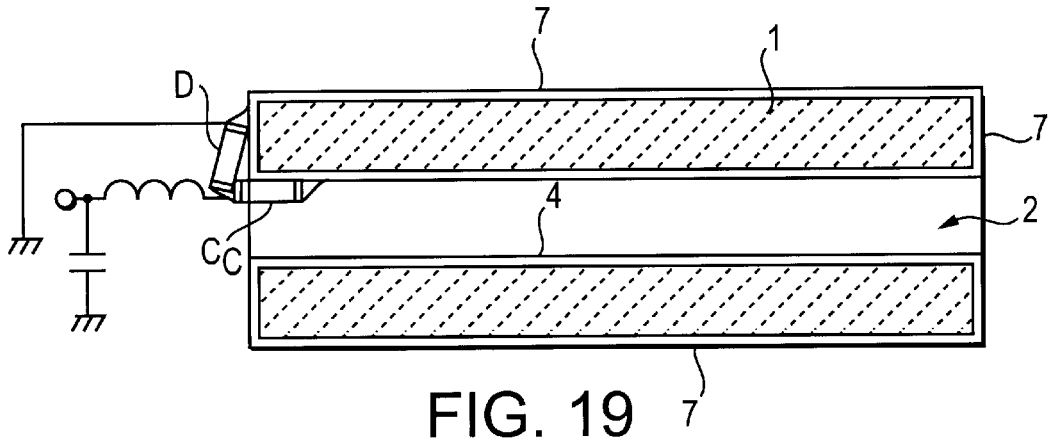
FIG. 19 is a cross-sectional view of a seventh embodiment of a filtering device according to the invention.

In the example shown in FIG. 19, an open-circuited end of the inner conductor 4 is formed on one open end of the inner conductor hole 2. A DC blocking capacitor Cc is disposed near the open end of the inner conductor hole 2 so that one end of the DC blocking capacitor Cc is connected to the inner conductor 4, and a diode switch D is disposed between the outer conductor 7 and the other end of the DC blocking capacitor Cc.

Figure 20:
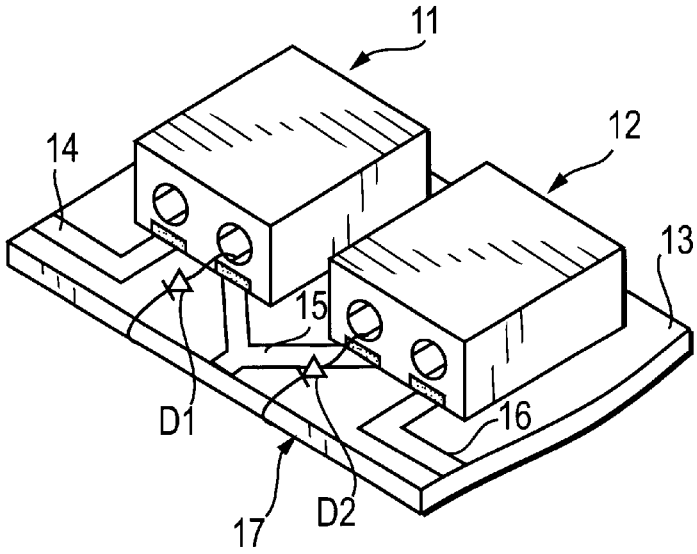
FIG. 20 is a perspective view of an eighth embodiment of a filtering device according to the invention.

FIG. 20 is a perspective view illustrating an eighth embodiment of a filtering device according to the invention. As shown in FIG. 20, this filtering device includes two mono-block dielectric filters 11 and 12 each having two inner conductor holes formed in a dielectric block wherein each dielectric filter is surface-mounted on a dielectric plate 13. Microstrips 14, 15, and 16 are formed on the upper surface of the dielectric plate (microstrip substrate) 13, and a ground conductor 17 is formed on the back surface of the dielectric plate 13. The microstrip 15 is connected to the input/output terminals of the respective dielectric filters 11 and 12 so that the input/output terminals are connected to an antenna terminal via the microstrip 15. The microstrips 14 ad 16 are connected to the other input/output terminals of the respective dielectric filters 11 and 12 so that they are connected to RX and TX terminals, respectively. The open-circuited ends of the inner conductors in the inner conductor holes forming antenna-side resonators of the respective dielectric filters 11 and 12 are connected to the ground conductor 17 via switches D1 and D2, respectively. In FIG. 20, some elements such as DC blocking capacitors are not shown for simplicity.

Figure 21:
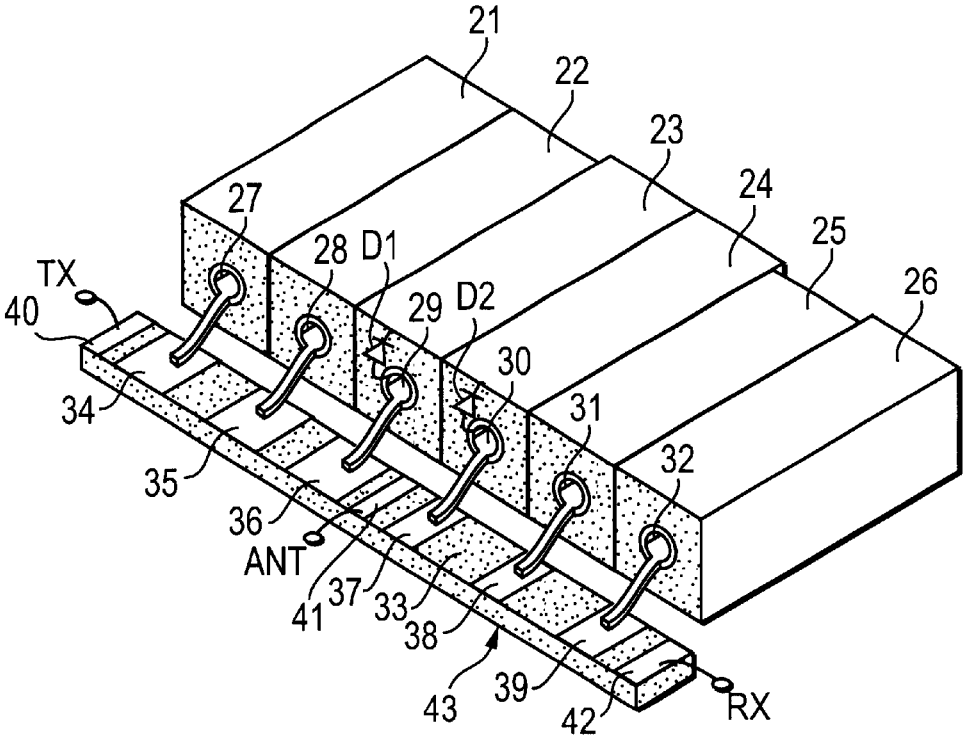
FIG. 21 is a perspective view of a ninth embodiment of a filtering device according to the invention.

FIGS. 21, 22(A), 22(B) and 22(C) illustrate a ninth embodiment of a filtering device using dielectric coaxial resonators. In FIG. 21, reference numerals 21 to 26 denote dielectric coaxial resonators. Lead terminals 27 to 32 are inserted into the inner conductor holes of the respective dielectric coaxial resonators 21 to 26. Reference numeral 33 denotes a coupling substrate. Coupling electrodes 34 to 39 and input/output electrodes 40, 41, and 42 are formed on the upper surface of the coupling substrate 33, and the back surface thereof is covered with a ground electrode 43. The lead terminals 27 to 32 of the dielectric coaxial resonators are connected to the corresponding coupling electrodes 34 to 39 by means of soldering or the like. The lead terminals 29 and 30 are connected to the outer conductor of the corresponding dielectric coaxial resonators via switches D1 and D2, respectively.

Figure 22A:
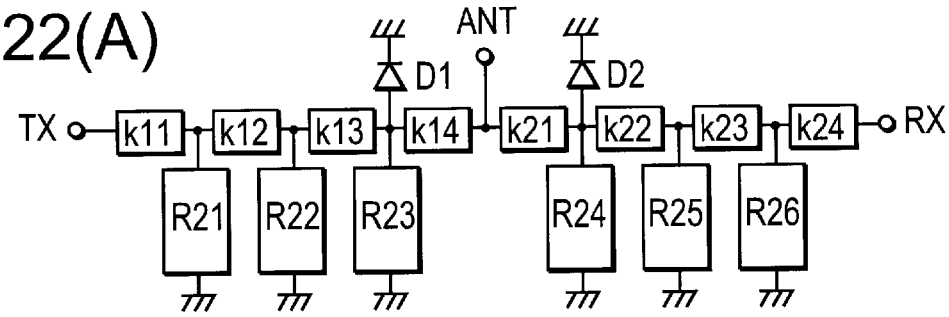
FIGS. 22(A), 22(B) and 22(C) are equivalent circuit diagrams of the filtering device according to the ninth embodiment of the invention.
Figure 22B:
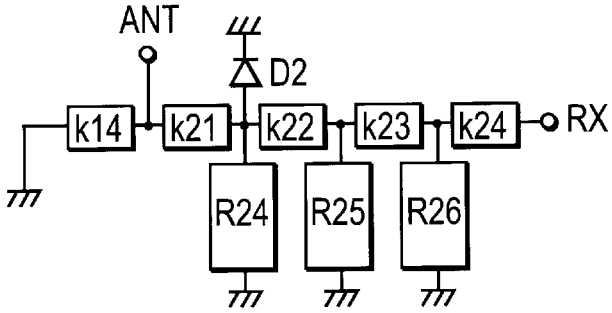
Figure 22C:
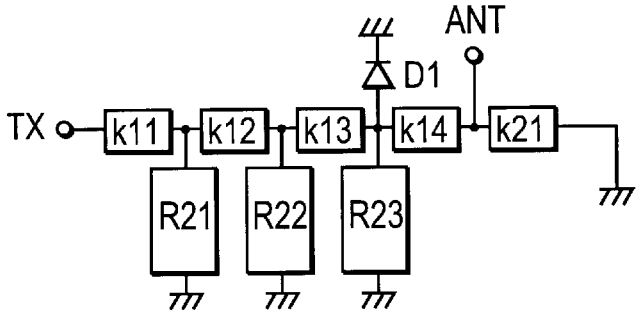

FIGS. 22(A), 22(B), 22(C) indicate an equivalent circuit of the filtering device shown in FIG. 21. In these figures, k11 to k14 and k21 to k24 are coupling reactances (capacitors) present on the coupling substrate shown in FIG. 21. Adjacent resonators are capacitively coupled with each other via these coupling reactances. If the switch D1 is turned on, the end of the capacitor k14 opposite to the end connected to the ANT terminal is grounded as shown in the equivalent circuit of FIG. 22(B), and thus the part between the ANT terminal and the RX terminal acts as a reception filter. Conversely, if the switch D2 is turned on, the end of the capacitor k21 opposite to the end connected to the ANT terminal is grounded as shown in the equivalent circuit of FIG. 22(C), and thus the part between the ANT terminal and the TX terminal acts as a transmission filter. Unlike the filtering device shown in FIG. 9 in which both reception filter and transmission filter are formed in a single dielectric block, reactances k14 and k21 are realized by actual external devices.

In the example shown in FIG. 21, capacitors are formed on the coupling substrate 33. Alternatively, chip capacitors serving as coupling elements may be mounted on a coupling substrate or directly on dielectric coaxial resonators so that resonates are coupled via these chip capacitors.

Figure 23:
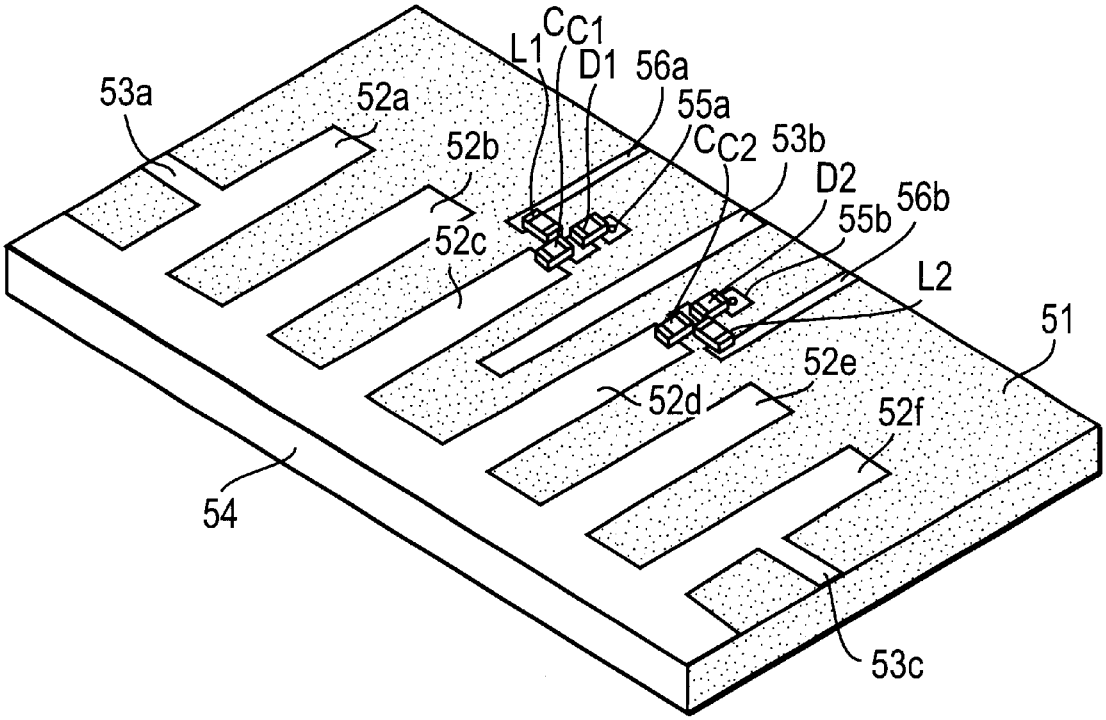
FIG. 23 is a perspective view of a tenth embodiment of a filtering device according to the invention.
Figure 24:
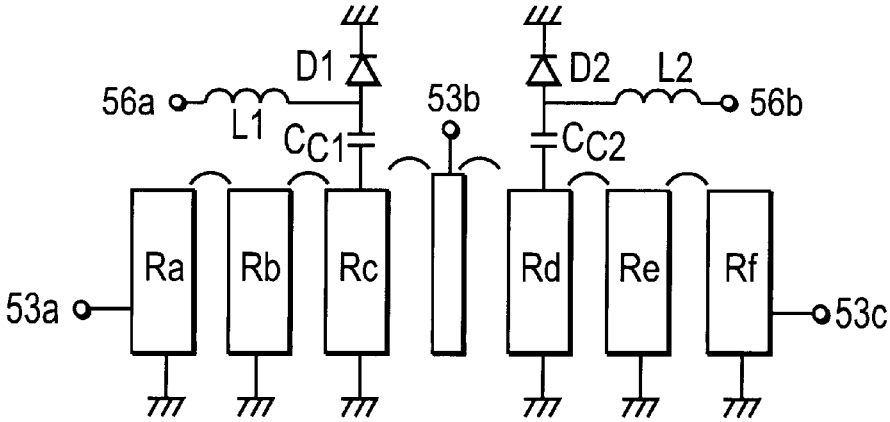
FIG. 24 is an equivalent circuit diagram of the filtering device according to the tenth embodiment of the invention.

FIGS. 23 and 24 illustrate a tenth embodiment of a filtering device using a dielectric plate. As shown in the perspective view of FIG. 23, resonance electrodes 52*a* to 52*f* and input/output electrodes 53*a*, 53*b*, and 53*c* are formed on the upper surface of the dielectric plate 51. A ground electrode 54 is formed in such a manner that it extends from the upper surface of the dielectric plate 51 to the lower surface via a side face as shown in FIG. 23. In this structure, comb-line microstrips form two bandpass filters which share the input/output electrode 53*b*. Through-hole electrodes 55*a* and 55*b* electrically connected to the ground electrode formed on the lower surface of the dielectric plate 51, and bias electrodes 56*a* and 56*b* are formed on the upper surface of the dielectric plate 51. Furthermore, auxiliary electrodes are formed on the upper surface of the dielectric plate 51 at locations between the resonance electrodes 52*c* and 52*d* and the through-hole electrodes 55*a* and 55*b*, and the resonance electrodes 52*c* and 52*d* are connected to the corresponding auxiliary electrodes via DC blocking capacitors $C_{c1}$ and $C_{c2}$, respectively. Furthermore, auxiliary electrodes are connected to the bias electrodes 56*a* and 56*b* via RF choke coils (chip coils) L1 and L2, respectively.

FIG. 24 illustrates an equivalent circuit of the filtering device described above. In FIG. 24, Ra to Rf correspond to resonance electrodes 52*a* to 52*f* acting as resonators shown in FIG. 23. If a positive bias voltage is applied to the bias electrode 56*a* thereby turning on the switch D1, the resonance electrode 52*c* comes to behave as a resonance electrode both ends of which are short-circuited. As a result, the part between the input/output electrodes 53*b* and 53*a* does not operate as a bandpass filter, and thus it is possible to selectively use the part between the input/output electrodes 53*b* and 53*c* as a bandpass filter. Conversely, if a positive bias voltage is applied to the bias electrode 56*b* thereby turning on the switch D2, the resonance electrode 52*d* comes to behave as a resonance electrode both ends of which are short-circuited. As a result, the part between the input/output electrodes 53*b* and 53*c* does not operate as a bandpass filter, and thus it is possible to selectively use the part between the input/output electrodes 53*a* and 53*b* as a bandpass filter. In the construction shown in FIG. 24, capacitors used in the RF choke circuits may also be mounted on the dielectric plate 51.

Figure 25:
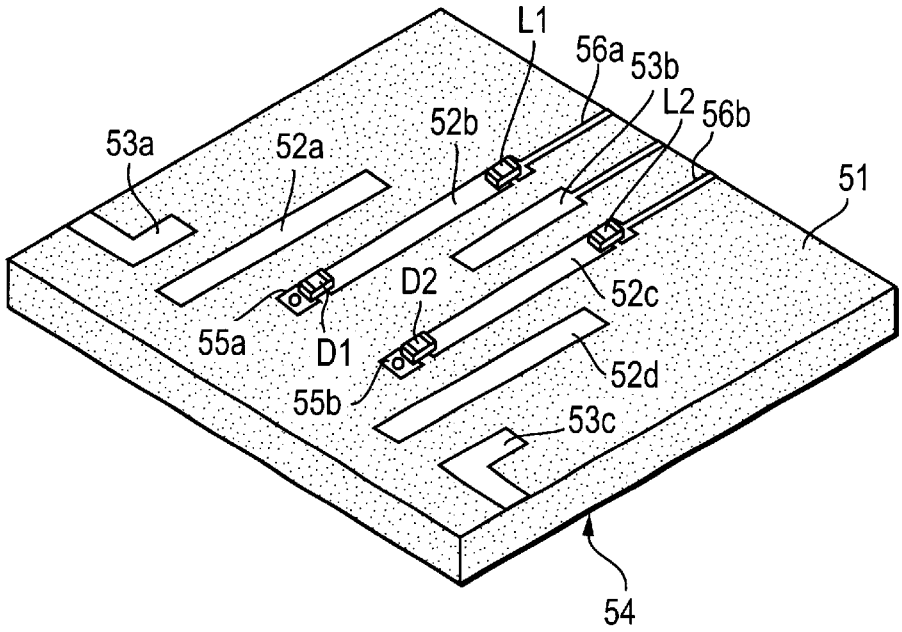
FIG. 25 is a perspective view of an eleventh embodiment of a filtering device according to the invention.

FIG. 25 is a perspective view illustrating an eleventh embodiment of a filtering device according to the invention. Resonance electrodes 52*a* to 52*d*, input/output electrodes 53*a*–53*c*, through-hole electrodes 55*a* and 55*b*, and bias electrodes 56*a* and 56*b* are formed on the upper surface of the dielectric plate 51. The lower surface of the dielectric plate 51 is covered with a ground electrode 54. One end of each resonance electrode 52*b* and 52*c* is connected to the through-hole electrode 55*a* or 55*b* via a diode switch D1 or D2. The opposite end of each resonance electrode 52*b* and 52*c* is connected to the bias electrode 56*a* or 56*b* via an RF choke coil (chip coil) L1 or L2.

Figure 26:
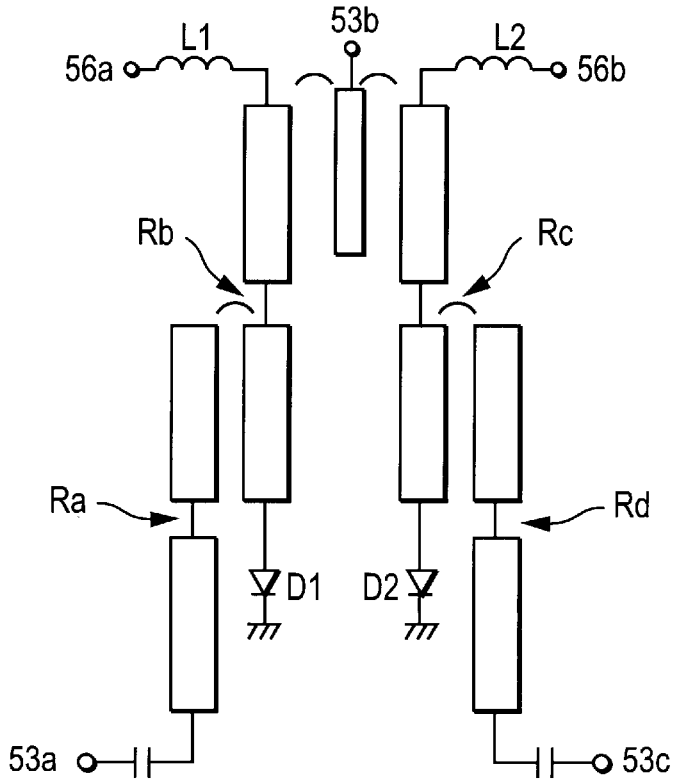
FIG. 26 is an equivalent circuit diagram of the filtering device according to the eleventh embodiment of the invention.

FIG. 26 illustrates an equivalent circuit of the filtering device shown in FIG. 25. In FIG. 26, Ra to Rd correspond to resonance electrodes 52*a* to 52*d* acting as resonators shown in FIG. 25. Each of these resonators behaves as a λ/2 resonator wherein these resonators are disposed so that there is a phase shift of λ/4 between adjacent resonators thereby achieving coupling between adjacent resonators. If a positive bias voltage is applied to the bias electrode 56*a* thereby turning on the switch D1, the resonator Rb as a whole behaves as a λ/4 resonator. As a result, the impedance of the resonator Rb seen from the input/output electrode 53*b* becomes very high at frequencies in the signal frequency band, and thus only the part between the input/output electrodes 53*b* to 53*c* operates as a bandpass filter. Conversely, if a positive bias voltage is applied to the bias electrode 56*b* thereby turning on the switch D2, the resonator Rc as a whole behaves as a λ/4 resonator. As a result, the impedance of the resonator Rc seen from the input/output electrode 53*b* becomes very high at frequencies in the signal frequency band, and thus only the part between the input/output electrodes 53*b* to 53*a* operates as a bandpass filter.

Figure 27:
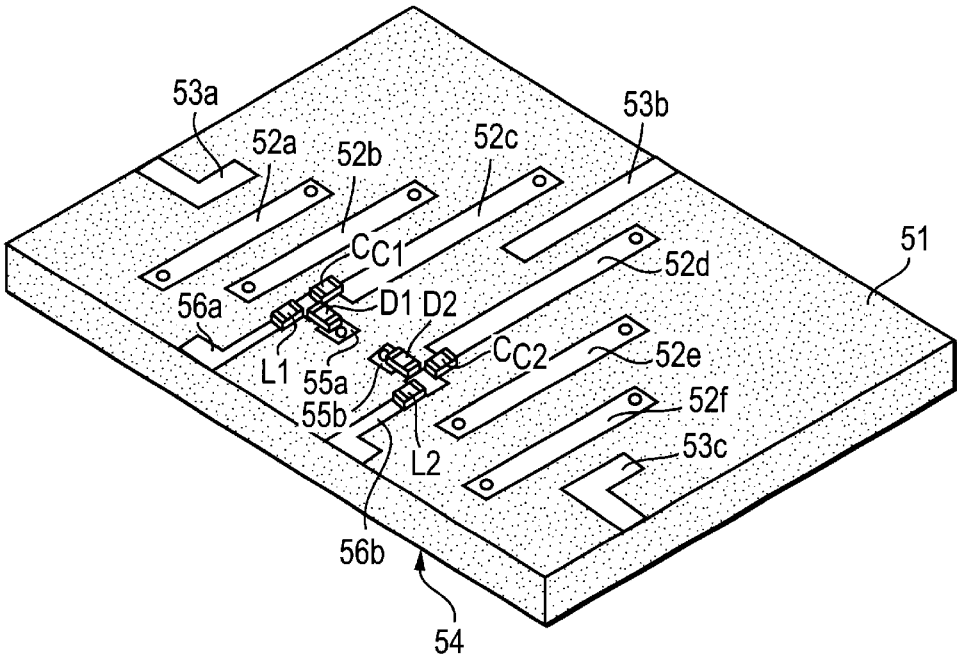
FIG. 27 is a perspective view of a twelfth embodiment of a filtering device according to the invention.
Figure 28:
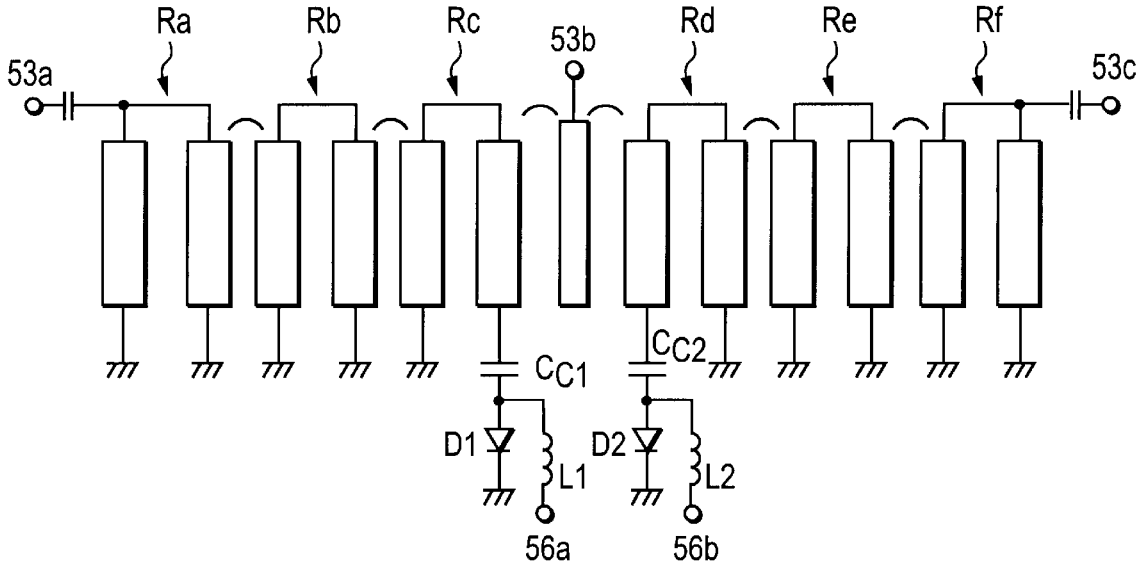
FIG. 28 is an equivalent circuit diagram of the filtering device according to the twelfth embodiment of the invention.

FIGS. 27 and 28 are a perspective view and an equivalent circuit diagram of a filtering device according to a twelfth embodiment of the invention. Resonance electrodes 52*a* to 52*f,* input/output electrodes 53*a* to 53*c,* through-hole electrodes 55*a* and 55*b,* and bias electrodes 56*a* and 56*b* are formed on the upper surface of the dielectric plate 51. The lower surface of the dielectric plate 51 is covered with a ground electrode 54. Through-holes are formed in the dielectric plate 51 at locations on both ends of each resonance electrode so that both ends are short-circuited. The equivalent circuit of this filtering device is shown in FIG. 28. Each resonator Ra, Rb, Re, and Rf acts as a λ/2 resonator both ends of which are short-circuited. When both switches D1 and D2 are in an open state, the resonators Rc and Rd act as a λ/4 resonator, while they act as a λ/2 resonator when both switches are in a closed state. Therefore, if a positive bias voltage is applied to the bias electrode 56*a,* the resonators Ra to Rc each behave as a λ/2 resonator, and the part between the input/output terminals 53*a* and 53*b* operates as a bandpass filter consisting of three stages of resonators. Conversely, if a positive bias voltage is applied to the bias electrode 56*b,* the resonators Rd to Rf each behave as a λ/2 resonator, and the part between the input/output terminals 53*b* and 53*c* operates as a bandpass filter consisting of three stages of resonators.

FIGS. 29 and 30 are a perspective view and an equivalent circuit diagram of a filtering device according to a thirteenth embodiment of the invention. As shown in FIG. 29, resonance electrodes 52*a* to 52*d,* input/output electrodes 53*a* to 53*c,* a through-hole electrode 55, and bias electrodes 56*a* and 56*b* are formed on the upper surface of the dielectric plate 51. The lower surface of the dielectric plate 51 is covered with a ground electrode 54. Through-holes are formed in the dielectric plate 51 at locations on both ends of each resonance electrode so that both ends are short-circuited. The equivalent circuit of this filtering device is shown in FIG. 30. Each resonator Ra to Rd acts as a λ/2 resonator both ends of which are short-circuited. When both switches D1 and D2 are turned on into a closed state, the center positions, which act equivalently as open-circuited terminals, of the resonance electrodes 52*b* and 52*c* are short-circuited, and the equivalent lengths of the resonators become half. Therefore, when a positive bias voltage is applied to the bias electrode 56*a,* the part between the input/output electrodes 53*a* and 53*b* does not operate as a filter, but the part between the input/output electrodes 53*b* and 53*c* operates as a bandpass filter consisting of two stages of resonators. Conversely, if a positive bias voltage is applied to the bias electrode 56*b,* the part between the input/output electrodes 53*c* and 53*d* does not operate as a filter, but the part between the input/output electrodes 53*a* and 53*b* operates as a bandpass filter consisting of two stages of resonators.

Figure 3:
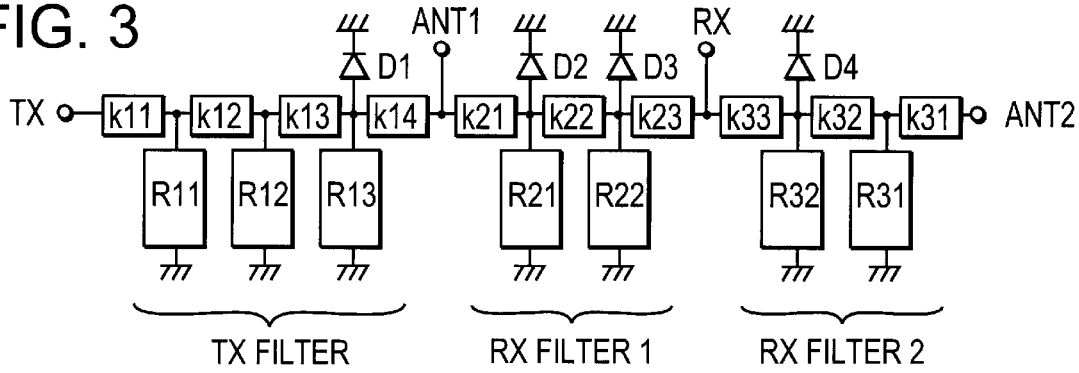
FIG. 3 is a diagram illustrating still another example of the configuration of a filtering device according to a first or fourth aspect of the invention.
Figure 4:
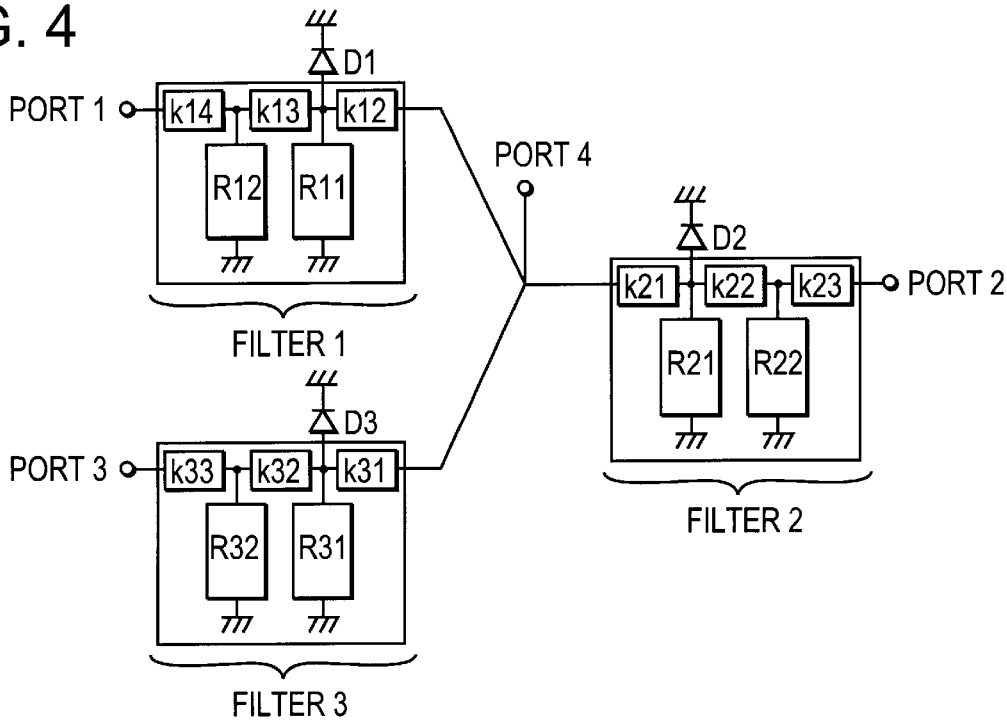
FIG. 4 is a diagram illustrating a further example of the configuration of a filtering device according to a first or fourth aspect of the invention.
Figure 5:
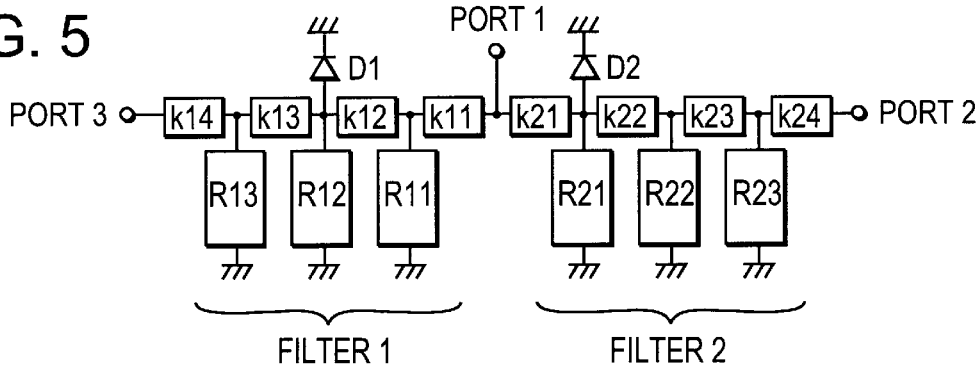
FIG. 5 is a diagram illustrating an example of the configuration of a filtering device according to a fifth aspect of the invention.
Figure 6:
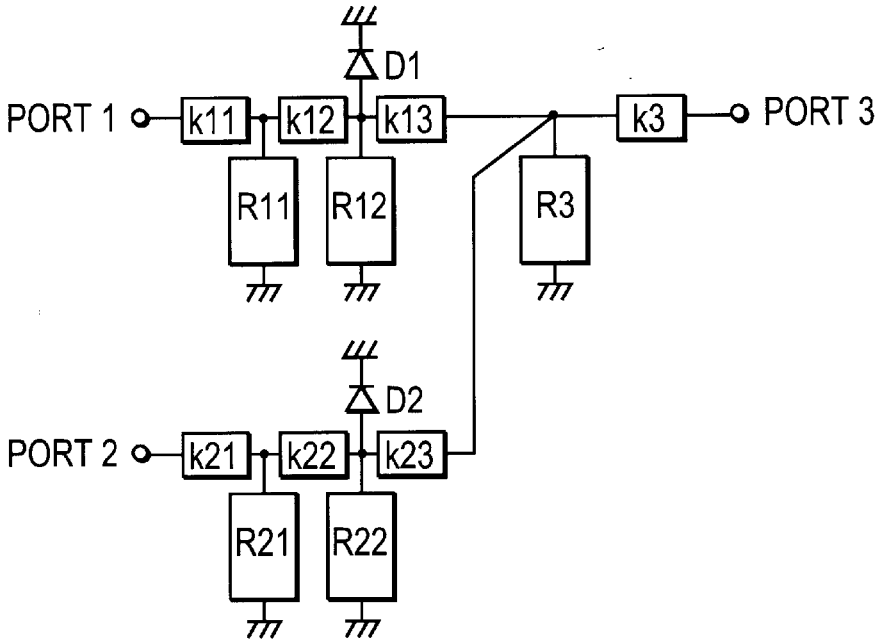
FIG. 6 is a diagram illustrating an example of the configuration of a filtering device according to a sixth aspect of the invention.
Figure 7A:
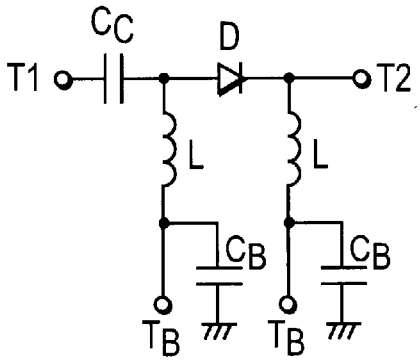
FIGS. 7(A) and 7(B) are diagrams illustrating examples of the configuration of a circuit for supplying a bias voltage to a diode switch.
Figure 7B:
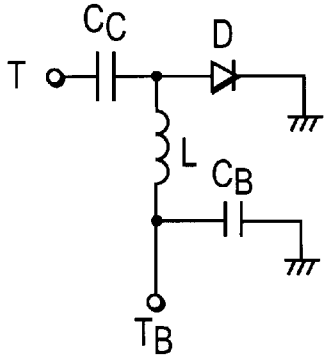
Figure 8A:
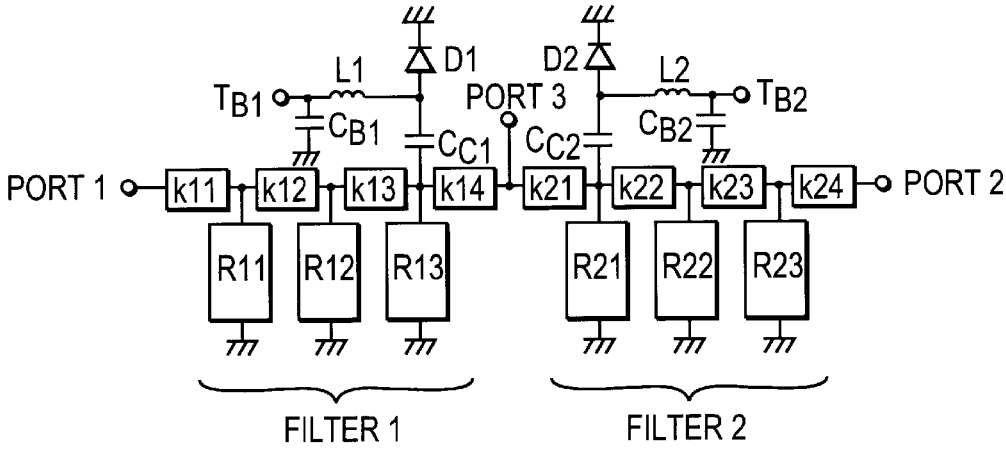
FIGS. 8(A) and 8(B) are diagrams illustrating another example of the configuration of a circuit for supplying a bias voltage to a diode switch.
Figure 8B:
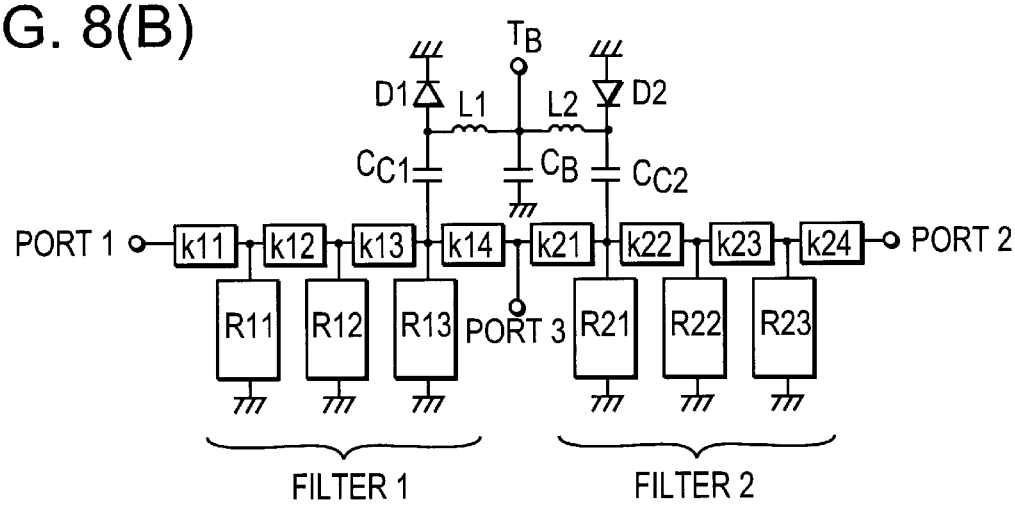

In the above embodiments, the filtering device operating as a duplexer is disclosed. In the same manner, the filtering device can also operates as a multiplexer by providing the filter between each of at least 4 input/output portion, as shown in FIGS. 3 and 4.

The filter device according to the present invention has various advantages as described below.

In the filtering device according to any of first to fourth aspects of the invention, elements such as a coil, a capacitor, and a transmission line which are required only to form a phase shift circuit in the conventional technique and which are not essential to the filter device are no longer necessary. This makes it possible to achieve a filtering device with a reduced size at a low cost.

In the filtering device according to the fifth aspect of the invention, the characteristics of the filter can be switched by means of controlling a switch. This makes it possible to realize a filtering device capable of functioning in various manners using a small number of components or elements.

According to the sixth aspect of the invention, a filtering device is constructed in such a manner that a distributed-parameter resonance line is shared by a plurality of filters wherein either one of the plurality of filters can be used selectively.

In the filtering device according to the seventh aspect of the invention, a plurality of filters are formed in a dielectric block in such a manner that either one of the plurality of filters can be used selectively.

In the filtering device according to the eighth aspect of the invention, a plurality of filters are realized using a plurality of dielectric coaxial resonators in such a manner that either one of the plurality of filters can be used selectively.

In the filtering device according to the ninth or tenth aspect of the invention, a switch element such as a diode switch is disposed on the filtering device in an integral fashion. This makes it easier to realize a filtering device with a reduced size.

According to the eleventh or twelfth aspect of the invention, a switch element such as a diode switch is disposed in an integral fashion on a filtering device comprising a microstrip line. This makes it possible to realize a filtering device with a reduced total size.

What is claimed is:

1. A filtering device comprising:

a plurality of filters, each said filter having at least one distributed-parameter resonance line, at least one end of which is open-circuited;

a coupling element in each said filter, said coupling element being coupled to said at least one said distributed-parameter resonance line in the corresponding said filter; and a switch in at least one said filter, said switch being connected to said open-circuited end of said at least one distributed-parameter resonance line in the corresponding said filter and to ground, so that said at least one distributed-parameter resonance line is short-circuited to ground when said switch is ON, thereby isolating said at least one filter from said coupling element;

wherein said distributed-parameter resonance lines respectively comprise a corresponding plurality of dielectric coaxial resonators each having an inner conductor formed in a dielectric block and an outer conductor formed on an outer surface of said dielectric block; and wherein each said inner conductor is formed on the inner surface of a corresponding hole produced in said dielectric block, and said switch is disposed inside said hole.

2. A filtering device according to claim 1, wherein said dielectric coaxial resonators are disposed interdigitally.

3. A filtering device comprising:

a plurality of filters, each said filter having at least one distributed-parameter resonance line, at least one end of which is open-circuited, a coupling element in each said filter, said coupling element being coupled to said at least one said distributed-parameter resonance line in the corresponding said filter; and a switch in at least one said filter, said switch being connected to said open-circuited end of said at least one distributed-parameter resonance line in the corresponding said filter and to ground, so that said at least one distributed-parameter resonance line is short-circuited to ground when said switch is ON, thereby isolating said at least one filter from said coupling element;

wherein said distributed-parameter resonance lines respectively comprise a corresponding, plurality of inner conductors formed in a dielectric block; and wherein each said inner conductor is formed on the inner surface of a corresponding hole produced in said dielectric block, and said switch is disposed inside said hole.

4. A filtering device according to claim 3, wherein said distributed-parameter resonance lines arc disposed interdigitally.

5. A filtering device comprising:

a plurality of filters, each said filter having at least one distributed-parameter resonance line, at least one end of which is open-circuited;

a coupling element in each said filter, said coupling element being coupled to said at least one said distributed-parameter resonance line in the corresponding said filter; and a switch in at least one said filter, said switch being connected to said open-circuited end of said at least one distributed-parameter resonance line in the corresponding said filter and to ground, so that said at least one distributed-parameter resonance line is short-circuited to ground when said switch is ON, thereby isolating said at least one filter from said coupling element;

wherein said distributed-parameter resonance lines are disposed interdigitally.

6. A filtering device according to claim 5, wherein both ends of each said distributed-parameter resonance line are open-circuited.

7. A duplexer comprising:

a pair of filters, each said filter having at least one distributed-parameter resonance line, at least one end of which is open-circuited;

a coupling element in each said filter, said coupling element being coupled to said at least one said distributed-parameter resonance line in the corresponding said filter; and a switch in at least one said filter, said switch being connected to said open-circuited end of said at least one distributed-parameter resonance line in the corresponding said filter and to ground, so that said at least one distributed-parameter resonance line is short-circuited to ground when said switch is ON, thereby isolating said at least one filter from said coupling element;

an input port connected in common to said pair of filters;

a pair of output ports connected respectively to said pair of filters; and said at least one distributed-parameter resonance line in each said filter being adjacent to said input port;

wherein each said distributed-parameter resonance line comprises an inner conductor which is formed on the inner surface of a corresponding hole produced in a dielectric block, and said switch is disposed inside said hole.

8. A filtering device according to claim 7, wherein said distributed-parameter resonance lines are disposed interdigitally.

9. A duplexer comprising:

a pair of filters, each said filter having at least one distributed-parameter resonance line, at least one end of which is open-circuited;

a coupling element in each said filter, said coupling element being coupled to said at least one said distributed-parameter resonance line in the corresponding said filter; and a switch in at least one said filter, said switch being connected to said open-circuited end of said at least one distributed-parameter resonance line in the corresponding said filter and to ground, so that said at least one distributed-parameter resonance line is short-circuited to ground when said switch is ON, thereby isolating said at least one filter from said coupling element;

an input port connected in common to said pair of filters;

a pair of output ports connected respectively to said pair of filters; and said at least one distributed-parameter resonance line in each said filter being adjacent to said input port;

wherein said distributed-parameter resonance lines are disposed interdigitally.

* * * * *